US011232889B2

(12) United States Patent
Doto et al.

(10) Patent No.: US 11,232,889 B2
(45) **Date of Patent: *Jan. 25, 2022**

(54) R-T-B BASED PERMANENT MAGNET

(71) Applicant: TDK CORPORATION, Tokyo (JP)

(72) Inventors: Hiroshi Doto, Tokyo (JP); Kiyoyuki Masuzawa, Tokyo (JP); Makoto Nakane, Tokyo (JP)

(73) Assignee: TDK CORPORATION, Tokyo (JP)

( * ) Notice: Subject to any disclaimer, the term of this patent is extended or adjusted under 35 U.S.C. 154(b) by 139 days.

This patent is subject to a terminal disclaimer.

(21) Appl. No.: 16/202,763

(22) Filed: Nov. 28, 2018

(65) Prior Publication Data

US 2019/0172615 A1 Jun. 6, 2019

(30) Foreign Application Priority Data

Dec. 5, 2017 (JP) ..... JP2017-233832

(51) Int. Cl.
*H01F 1/057* (2006.01)
*H01F 41/02* (2006.01)

(52) U.S. Cl.
CPC ..... *H01F 1/0577* (2013.01); *H01F 41/0293* (2013.01)

(58) Field of Classification Search
None
See application file for complete search history.

(56) References Cited

U.S. PATENT DOCUMENTS 6,296,720 B1 10/2001 Yamamoto et al.
10,672,544 B2 * 6/2020 Masusawa ..... C22C 38/04
2008/0245442 A1 10/2008 Nakamura et al.
2008/0274009 A1 * 11/2008 Tomizawa ..... C22C 38/005 420/83
2009/0297699 A1 * 12/2009 Baba ..... H01F 41/0293 427/127
2010/0233016 A1 * 9/2010 Tsubokura ..... C22C 38/10 420/83
2011/0025440 A1 2/2011 Kuniyoshi et al.
2011/0150691 A1 6/2011 Nakamura et al.
(Continued)

FOREIGN PATENT DOCUMENTS

CN 1258082 A 6/2000
CN 107039136 A 8/2017
(Continued)

OTHER PUBLICATIONS

Machine translation of JP2009-302318A. (Year: 2009).*

*Primary Examiner* — Xiaowei Su
(74) *Attorney, Agent, or Firm* — Oliff PLC

(57) ABSTRACT

An A R-T-B based permanent magnet, wherein R is a rare earth element, T is Fe and Co, and B is boron. R at least includes Dy and Tb. The R-T-B based permanent magnet includes M, and M is one or more elements selected from the group made of Cu, Ga, Al, Mn, Zr, Ti, Cr, Ni, Nb, Ag, Hf, Ta, W, Si, Bi, and Sn. M at least includes Cu. A total content of R is 28.05 mass % to 30.60 mass %, a content of Dy is 1.0 mass % to 6.5 mass %, a content of Cu is 0.04 mass % to 0.50 mass %, a content of Co is 0.5 mass % to 3.0 mass %, and a content of B is 0.85 mass % to 0.95 mass %. A concentration distribution of Tb decreases from an outer side towards an inner side of the R-T-B based permanent magnet.

6 Claims, 1 Drawing Sheet

(56) References Cited

U.S. PATENT DOCUMENTS

| | | | | |
|---|---|---|---|---|
| 2013/0293328 | A1* | 11/2013 | Kuniyoshi | C22C 33/0278 335/302 |
| 2016/0284468 | A1 | 9/2016 | Yamagata et al. | |
| 2017/0103835 | A1* | 4/2017 | Hidaka | C22C 38/10 |
| 2019/0172616 | A1* | 6/2019 | Doto | H01F 41/0293 |

FOREIGN PATENT DOCUMENTS

| | | | | |
|---|---|---|---|---|
| JP | 2009302318 | A | * | 12/2009 |
| JP | 2014-160760 | A | | 9/2014 |
| WO | 2006/043348 | A1 | | 4/2006 |
| WO | 2009/122709 | A1 | | 10/2009 |
| WO | 2015/030231 | A1 | | 3/2015 |

* cited by examiner

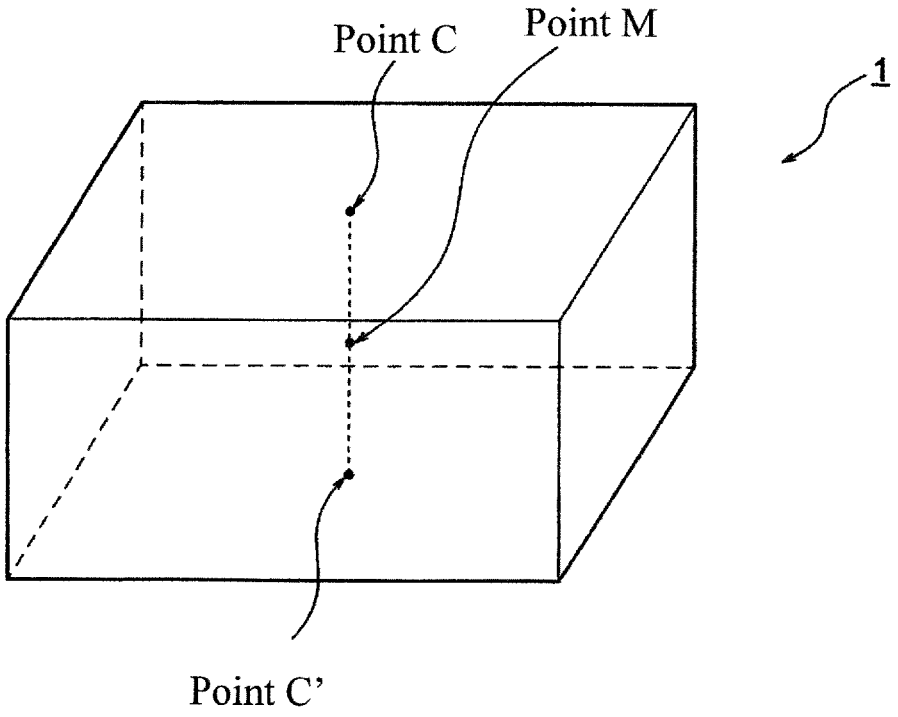
Point C
Point M
1
Point C'

R-T-B BASED PERMANENT MAGNET

TECHNICAL FIELD

The present invention relates to an R-T-B based permanent magnet.

BACKGROUND

A rare earth permanent magnet having an R-T-B based composition is a magnet showing superior magnetic properties, and many investigations are performed to further improve the magnetic properties. Indexes which show the magnetic properties are generally a residual magnetic flux density (residual magnetization) Br and a coercive force HcJ. A magnet having high values thereof is determined to have superior magnetic properties.

Patent Document 1 mentions a rare earth permanent magnet, in which a magnet body is immersed in slurry dispersed with fine powder including a rare earth element in water or organic solvent, then heating is carried out, and thereby diffusing the rare earth element into the magnet body along the grain boundaries.

[Patent Document 1] Patent Document 1: A brochure of WO 2006/43348

SUMMARY

An object of the present invention is to provide an R-T-B based permanent magnet showing high residual magnetic flux density Br and coercive force HcJ.

In order to attain the above object, the R-T-B based permanent magnet according to the present invention is an R-T-B based permanent magnet comprising M, wherein R is a rare earth element, T is Fe and Co, and B is boron, R at least includes Dy and Tb, M is one or more elements selected from the group consisting of Cu, Ga, Al, Mn, Zr, Ti, Cr, Ni, Nb, Ag, Hf, Ta, W, Si, Bi, and Sn, M at least includes Cu, a total content of R is 28.05 mass % to 30.60 mass %, a content of Dy is 1.0 mass % to 6.5 mass %, a content of Cu is 0.04 mass % to 0.50 mass %, a content of Co is 0.5 mass % to 3.0 mass %, and a content of B is 0.85 mass % to 0.95 mass %, and a concentration distribution of Tb decreases from an outer side towards an inner side of the R-T-B based permanent magnet.

The R-T-B based permanent magnet according to the present invention has the above mentioned specific range of compositions and concentrations, thereby the R-T-B based permanent magnet having high residual magnetic flux density Br and coercive force HcJ is obtained.

R may at least include Nd.

R may include at least Pr, and a content of Pr may be larger than zero mass % and 10.0 mass % or less, or may be 5.0 mass % to 10.0 mass %.

A content of Dy may be 2.5 mass % to 6.5 mass %.

R may include at least Nd and Pr.

M may further include Ga, and a content of Ga may be 0.08 mass % to 0.30 mass %.

M may further include Al, and a content of Al may be 0.15 mass % to 0.30 mass %.

M may further include Zr, and a content of Zr may be 0.10 mass % to 0.30 mass %.

An atomic ratio TRE/B may be 2.21 to 2.62, where a total content of R is TRE.

An atomic ratio of Tb/C may be 0.10 to 0.95.

An atomic ratio of 14B/(Fe+Co) may be 1.01 or less.

BRIEF DESCRIPTION OF THE DRAWINGS

FIGURE is a schematic view of the R-T-B based permanent magnet according to the present embodiment.

DETAILED EMBODIMENTS

Hereinafter, the invention will be described based on the embodiment shown by FIGURE.

<R-T-B Based Permanent Magnet>

An R-T-B based permanent magnet 1 according to the embodiment includes grains made of $R_2T_{14}B$ crystals and grain boundaries thereof.

The R-T-B based permanent magnet 1 according to the present embodiment can be any shape.

The R-T-B based permanent magnet 1 according to the present embodiment can enhance a residual magnetic flux density Br, a coercive force HcJ, a corrosion resistance, and a production stability by including a plurality of specific elements including Tb within a specified range of their content.

Also, the R-T-B based permanent magnet 1 according to the embodiment shows a concentration distribution in which a concentration of Tb decreases from outer side to inner side of the R-T-B based permanent magnet 1.

Specifically, as shown in FIGURE, in case a rectangular parallelepiped shaped R-T-B based permanent magnet 1 of the present embodiment has a surface part and a central part, the content of Tb in the surface part may be higher than that of the central part by 2% or more, 5% or more, or 10% or more. Note that, the surface part is the surface of the R-T-B based permanent magnet 1. For instance, points C and C' in FIGURE (centers of gravity of the surfaces facing against each other shown in FIGURE) are the surface part. The central part is a center of the R-T-B based permanent magnet 1. For example, the central part refers to the part where the thickness of the R-T-B based permanent magnet 1 is half. For instance, a point M (a middle point between the points C and C') in FIGURE is the central part.

The above mentioned concentration distribution of the content of Tb can be generated by any method; however, the concentration distribution of Tb can be generated in the magnet by the grain boundary diffusion of Tb which is described in below.

R is the rare earth element. The rare earth element includes Sc, Y and lanthanoids which belong to the group III of the long-periodic table. In the present specification, lanthanoids include La, Ce, Pr, Nd, Sm, Eu, Gd, Tb, Dy, Ho, Er, Tm, Yb, and Lu. In addition, the R-T-B based permanent magnet according to the present embodiment always includes Tb as R. Further, Nd is preferably included as R.

The rare earth elements are generally classified as light rare earth elements and heavy rare earth elements. The light rare earth elements of the R-T-B based permanent magnet according to the present embodiment are Sc, Y, La, Ce, Pr, Nd, Sm, and Eu; and the heavy rare earth elements of the same are Gd, Tb, Dy, Ho, Er, Tm, Yb, and Lu.

T is Fe and Co. Also, transition metals which are not included in M, and inevitable impurities may be included. A content of transition metals which are not included in M or R, and the inevitable impurities is preferably 0.1 mass % or less, and more preferably it is 0.05 mass % or less. Note that, T does not include C, O, and N.

B is boron.

M is one or more elements selected from the group consisting of Cu, Ga, Al, Mn, Zr, Ti, Cr, Ni, Nb, Ag, Hf, Ta, W, Si, Bi, and Sn. Also, M includes Cu.

A total content of R in the R-T-B based permanent magnet is 28.05 mass % or more and 30.60 mass % or less relative to 100 mass % of a total mass of R, T, B, and M. In case the total content of R is less than 28.05 mass %, the coercive force HcJ decreases. In case the total content of R is larger than 30.60 mass %, the residual magnetic flux density Br decreases. Also, the total content of R may be 28.25 mass % or more and 30.60 mass % or less, 29.25 mass % or more and 30.60 mass % or less, 29.45 mass % or more and 30.60 mass % or less, or 29.45 mass % or more and 30.45 mass % or less. When the total content of R is 29.45 mass % or more, a degree of deformation during the sintering becomes less, and the production stability improves. As it is described in below, by making the total content of R within 29.45 mass % or more and 30.45 mass % or less, and also making the content of B within 0.88 mass % or more and 0.94 mass % or less, a squareness ratio Hk/HcJ further improves as well.

In case a total content of the light rare earth elements in the R-T-B based permanent magnet of the present embodiment is defined as TRL and a total mass of R, T, B, and M is 100 mass %, TRL may be 21.4 mass % or more and 29.1 mass % or less, or 21.4 mass % or more and 27.6 mass % or less. When TRL is within the above range, the magnetic properties can be enhanced.

A total content of Nd in the R-T-B based permanent magnet of the present invention is not particularly limited. Also, the content of Nd may be zero mass % to 30.1 mass %, zero mass % to 29.6 mass %, 19.6 mass % to 29.6 mass %, 19.6 mass % to 24.6 mass %, or 19.6 mass % to 22.6 mass % relative to 100 mass % of the total mass of R, T, B, and M. Also, the content of Pr may be 0.0 mass % to 10.0 mass %. That is, Pr may not be included. The R-T-B based permanent magnet according to the present embodiment may include Nd and Pr as R. In this case, the content of Pr may be 5.0 mass % or more and 10.0 mass % or less, or 5.0 mass % or more and 7.5 mass % or less. Also, when the content of Pr is 10.0 mass % or less, a temperature coefficient of the coercive force HcJ is superior. In particular, from the point of improving the coercive force HcJ at high temperatures, the content of Pr may be preferably 0.0 mass % to 7.5 mass %.

Also, the R-T-B based permanent magnet according to the present embodiment may include the heavy rare earth elements as R. As the heavy rare earth elements, Tb and Dy are included. The content of Dy is 1.0 mass % or more and 6.5 mass % or less relative to 100 mass % of the total mass of R, T, B, and M. In case the content of Dy is too small, the coercive force HcJ and the corrosion resistance decrease. In case the content of Dy is too large, the residual magnetic flux density Br decreases, which causes an increase in cost. Also, the content of Dy is preferably 2.5 mass % or more and 6.5 mass % or less. When the content of Dy is 2.5 mass % or more and 6.5 mass % or less, the coercive force HcJ further improves, and also a demagnetization factor at high temperature decreases.

The content of Tb may be 0.15 mass % or more and 1.0 mass % or less, 0.15 mass % or more and 0.75 mass % or less, or 0.15 mass % or more and 0.50 mass % or less relative to 100 mass % of the total mass of R, T, B, and M. By making the content of Tb to 0.15 mass % or more, the coercive force HcJ can be improved. By making the content of Tb to 1.0 mass % or less, the residual magnetic flux density Br can be maintained and the cost can be reduced.

The demagnetization factor at high temperature in the present specification is defined as described in below. First, a sample is magnetized by a pulse magnetic field of 4,000 kA/m. A total magnetic flux amount of the sample at room temperature (23° C.) is defined as B0. Next, the sample is exposed under a high temperature for 2 hours at 200° C., and then the temperature is turned back to room temperature. When the temperature of the sample is back to room temperature, the total magnetic flux amount is measured again, and this is defined as B1. When D is the demagnetization factor at high temperature of the present specification, D is as shown in below.

$$D=100*(B1-B0)/B0(\%)$$

When an absolute value of the demagnetization factor at high temperature calculated from the above equation is small, this may be simply referred that the demagnetization factor at high temperature is small.

The content of Co is 0.5 mass % or more and 3.0 mass % or less relative to 100 mass % of the total mass of R, T, B, and M. By including Co, the corrosion resistance improves. When the content of Co is less than 0.5 mass %, the corrosion resistance of the R-T-B based permanent magnet deteriorates. The Co content exceeding 3.0 mass % does not provide a further corrosion resistance enhancing effect and also results in increased cost. Also, the content of Co may be 1.0 mass % or more and 3.0 mass % or less.

The content of B is 0.85 mass % or more and 0.95 mass % or less relative to 100 mass % of the total mass of R, T, B, and M. When the content of B is less than 0.85 mass %, a high squareness ratio becomes difficult to attain. That is, it becomes difficult to improve the squareness ratio Hk/HcJ. When the content of B exceeds 0.95 mass %, the squareness ratio Hk/HcJ decreases. Also, the content of B may be 0.88 mass % or more and 0.94 mass % or less. By making the content of B to 0.88 mass % or more, the residual magnetic flux density Br tends to further improve. By making the content of B to 0.94 mass % or less, the coercive force HcJ tends to further improve.

Although the total M content is not particularly limited, the total M content is preferably 0.04 mass % or more and 1.5 mass % or less based on a total mass of R, T, B, and M of 100 mass %. When the total M content is excessively large, the residual magnetic flux density Br tends to decrease.

The content of Cu is 0.04 mass % or more and 0.50 mass % or less relative to 100 mass % of the total mass of R, T, B, and M. The coercive force HcJ tends to decrease when the content of Cu is less than 0.04 mass %. In case the content of Cu exceeds 0.50 mass %, the coercive force HcJ tends to decrease and the residual magnetic flux density Br also tends to decrease. In addition, the content of Cu may be 0.10 mass % or more and 0.50 mass % or less, or may be 0.10 mass % or more and 0.30 mass % or less. The corrosion resistance tends to improve by making the content of Cu to 0.10 mass % or more.

The content of Ga may be 0.08 mass % or more and 0.30 mass % or less relative to 100 mass % of the total mass of R, T, B, and M. The coercive force HcJ is sufficiently increased when the content of Ga is 0.08 mass % or more. Sub-phases (such as R-T-Ga phase) tend to be easily formed, and the residual magnetic flux density Br tends to decrease when the content of Ga exceeds 0.30 mass %. In addition, the content of Ga may be 0.10 mass % or more and 0.25 mass % or less.

The content of Al may be 0.15 mass % or more and 0.30 mass % or less relative to 100 mass % of the total mass of R, T, B, and M. In case the content of Al is 0.15 mass % or more, the coercive force HcJ can be increased. In addition, a difference of the coercive force HcJ due to changes of an aging temperature and a heat treatment temperature after the grain boundary diffusion becomes small, and the properties vary less during mass production. Namely, the production stability improves. The residual magnetic flux density Br can be improved when the content of Al is 0.30 mass % or less. The temperature coefficient of the coercive force HcJ can also be improved. Also, the content of Al may be 0.15 mass % or more and 0.25 mass % or less. The difference of the magnetic properties (particularly, the coercive force) due to changes of the aging temperature and the heat treatment temperature after the grain boundary diffusion becomes even smaller when the content of Al is 0.15 mass % or more and 0.25 mass % or less.

The content of Zr may be 0.10 mass % or more and 0.30 mass % or less relative to 100 mass % of the total mass of R, T, B, and M. An abnormal grain growth during sintering can be restricted, and the squareness ratio Hk/HcJ and a magnetization ratio under a low magnetic field can be improved by including Zr. By making the content of Zr to 0.10 mass % or more, the abnormal grain growth restricting effect during sintering is enhanced by including Zr, and the squareness ratio Hk/HcJ and the magnetization ratio under a low magnetic field can be improved. By making the content of Zr to 0.30 mass % or less, the residual magnetic flux density Br can be improved. Also, the content of Zr may be 0.15 mass % or more and 0.30 mass % or less, or may be 0.15 mass % or more and 0.25 mass % or less. By making the content of Zr to 0.15 mass % or more, an optimal temperature range for sintering becomes wide. Namely, the abnormal grain growth restricting effect during sintering is further enhanced. Further, the properties vary less, and the production stability improves.

In addition, the R-T-B based permanent magnet according to the present embodiment may include Mn. In case of including Mn, the content of Mn may be 0.02 mass % to 0.10 mass % relative to 100 mass % of the total mass of R, T, B, and M. By making the content of Mn to 0.02 mass % or more, the residual magnetic flux density Br tends to increase and the coercive force HcJ tends to improve. By making the content of Mn to 0.10 mass % or less, the coercive force HcJ tends to increase. Also, the content of Mn may be 0.02 mass % or more and 0.06 mass % or less.

Also, the atomic ratio of TRE/B may be 2.21 or more and 2.62 or less, where TRE is the total content of R. The residual magnetic flux density Br and the coercive force HcJ improve when TRE/B is within the above range.

Also, an atomic ratio of 14B/(Fe+Co) may be more than zero and 1.01 or less. The squareness ratio tends to increase when 14B/(Fe+Co) is 1.01 or less. 14B/(Fe+Co) may be 1.00 or less.

An atomic ratio Tb/C, in which the content of Tb is divided by the content of C, may be 0.10 or more to 0.95 or less. In case Tb/C is within the above range, superior temperature coefficient of the coercive force HcJ can be attained. Further, the coercive force HcJ at high temperature improves and the demagnetization factor at high temperature decreases. In addition, Tb/C may be 0.10 or more and 0.65 or less, 0.13 or more and 0.50 or less, or 0.20 or more and 0.45 or less. In addition, Tb/C may be 0.13 or more and 0.63 or less, 0.17 or more and 0.63 or less, 0.21 or more and 0.63 or less, or 0.21 or more and 0.44 or less.

The content of carbon C in the R-T-B based permanent magnet according to the present embodiment may be 1100 ppm or less, 1000 ppm or less, or 900 ppm or less relative to a total mass of the R-T-B based permanent magnet. It may further be 600 to 1100 ppm, 600 to 1000 ppm, or 600 to 900 ppm. The coercive force HcJ tends to increase when the content of carbon is 1100 ppm or less. In particular, from the point of improving the coercive force HcJ, the content of carbon can be 900 ppm or less. A production of the R-T-B based permanent magnet having the content of carbon of less than 600 ppm makes process conditions of the R-T-B based permanent magnet to be more difficult, which causes the cost to increase.

Note that, from the point of improving the squareness ratio Hk/HcJ, the content of carbon is 800 to 1100 ppm.

The content of nitrogen N in the R-T-B based permanent magnet according to the present embodiment may be 1000 ppm or less, 700 ppm or less, or 600 ppm or less relative to a total mass of the R-T-B based permanent magnet. The content of N may be 250 to 1000 ppm, 250 to 700 ppm, or 250 to 600 ppm. The coercive force HcJ tends to easily increase as the content of nitrogen decreases. The production of the R-T-B based permanent magnet having the content of nitrogen of less than 250 ppm makes process conditions of the R-T-B based permanent magnet to be more difficult, which causes the cost to increase.

The content of oxygen O in the R-T-B based permanent magnet according to the present embodiment may be 1000 ppm or less, 800 ppm or less, 700 ppm or less, or 500 ppm or less relative to the total mass of the R-T-B based permanent magnet. In addition, it may be 350 ppm to 500 ppm. Although there is no particular lower limit of the content of oxygen, the production of the R-T-B based permanent magnet having the content of oxygen of less than 350 ppm makes process conditions of the R-T-B based permanent magnet to become more difficult, which causes the cost to increase. Further, the corrosion resistance can be increased, by making the content of oxygen to 1000 ppm or more and 3000 ppm or less.

In addition, by making the total content of R before the grain boundary diffusion, which will be explained in below, to 29.1 mass % or more, and the content of oxygen to 1000 ppm or less, 800 ppm or less, 700 ppm or less, or 500 ppm or less, the deformation during sintering can be restricted and the production stability can be improved. Note that, when the total content of R before the below mentioned grain boundary diffusion is 29.1 mass % or more, the total content of R after the grain boundary diffusion is for example 29.25 mass % or more.

A possible reason that deformation during sintering can be suppressed by reducing the oxygen content while having a predetermined or higher total R content is as follows. The sintering mechanism of the R-T-B based sintered magnet is a liquid phase sintering, in which grain boundary phase component called R-rich phase melts to form liquid phase during the sintering and promotes densification. On the other hand, oxygen easily reacts with the R-rich phase, and rare earth oxide phase is formed as the content of oxygen increases and the R-rich phase amount decreases. Although in a very small quantity, oxidizing impurity gases generally exist in a sintering furnace. Therefore, during the sintering process, the R-rich phase is oxidized near the surface of a green compact, and the R-rich phase amount may locally decrease. For the composition having large total content of R and small content of oxygen, the R-rich phase amount is large, and an influence of the oxidation on the shrinking behavior during sintering becomes small. For the composition having small content of R and/or large content of oxygen, the oxidization during sintering affects the shrinking behavior because the R-rich phase amount is small. As a result, a sintered body is deformed by partial change in shrinkage, namely, partial change in size. Thus, the deformation during the sintering can be suppressed by making the total content of R to a predetermined amount or larger and by decreasing the content of oxygen.

Note that, a measuring method of various components included in the R-T-B based permanent magnet according to the present embodiment can be a conventionally and generally known method. Amounts of various elements can be measured for example by X-ray fluorescence analysis, an inductively coupled plasma atomic emission spectroscopy (ICP analysis), and the like. The content of oxygen is measured for example by an inert gas fusion-nondispersive infrared absorption method. The content of carbon is measured for example by combustion in oxygen stream-infrared absorption method. The content of nitrogen is measured for example by an inert gas fusion-thermal conductivity method.

In addition, the R-T-B based permanent magnet according to the present embodiment includes a plurality of main phase grains and grain boundaries. Main phase grain may be a core-shell grain comprising a core and a shell covering the core. Further, at least in the shell, the heavy rare earth element may be present, and Tb may be present.

By making the heavy rare earth element present in the shell part, it is possible to efficiently improve the magnetic properties of the R-T-B based permanent magnet.

In this embodiment, a part where the ratio of the heavy rare earth element to the light rare earth element (molar ratio of heavy rare earth element/light rare earth element) is twice or more compared to that of in the central part (core) of the main phase grain is defined as the shell.

There is no particular limitation on the thickness of the shell, but it may be 500 nm or less. In addition, the diameter of the main phase grain is also not particularly limited, but it may be 3.0 μm or more and 6.5 μm or less.

The main phase grain can be formed into the above-mentioned core-shell grain by any method. A grain boundary diffusion method described in below can be exemplified. The heavy rare earth element diffuses along the grain boundaries and the heavy rare earth element replaces the rare earth element R on the surfaces of the main phase grains. Then, the shell including high ratio of the heavy rare earth element is formed, and it becomes the core-shell grain.

Further, a content of B+C which is a total content of B and C may be less than 1.050 mass %, 0.920 mass % or more and less than 1.050 mass %, 0.940 mass % or more and less than 1.050 mass %, or 0.960 mass % or more and less than 1.050 mass %. By making the content of B+C to less than 1.050 mass %, the squareness ratio Hk/HcJ before and after the diffusion of the heavy rare earth element tends to improve. When the content B+C exceeds 1.050 mass %, the grain boundary phase is insufficiently formed, low coercive force component is locally generated, and the squareness ratio Hk/HcJ decreases.

Hereinafter, a manufacturing method of the R-T-B based permanent magnet is described in detail, however the manufacturing method of the R-T-B based permanent magnet is not limited thereto and other known methods can be used.

[Preparation Step of Raw Material Powder]

A raw material powder can be prepared by a known method. A single alloy method using a single alloy is described in the present embodiment; however, a so called two alloys method may be used to prepare the raw material powder, in which first and second alloys each having different composition are mixed.

First, a raw material alloy of the R-T-B based permanent magnet is prepared (an alloy preparation step). In the alloy preparation step, raw material metals corresponding to the composition of the R-T-B based permanent magnet of the present embodiment are melted by a known method, and then casting is carried out, thereby the raw material alloy having desired composition is prepared.

Examples of the raw material metals which can be used include metals such as rare earth metals or rare earth alloys, pure iron, ferroboron, Co, and Cu; and, moreover, alloys and compounds thereof; and the like. Any method can be used as a casting method for forming raw material metals into a raw material alloy by casting. In order to obtain the R-T-B based permanent magnet having increased magnetic properties, a strip casting method may be used. A homogenizing treatment may be performed on the obtained raw material alloy by a known method as necessary. Also, the heavy rare earth elements (Dy, Tb, and the like) may be added to the raw material metals, or may be introduced to the R-T-B based permanent magnet when carrying out grain boundary diffusion which is described in below. Preferably, Dy is added to the raw material alloy, and Tb is preferably introduced to the R-T-B based permanent magnet by grain boundary diffusion. Also, any method may be employed as the method of making the concentration distribution of Tb to have the concentration distribution decreasing from the outer side towards the inner side of the R-T-B based permanent magnet, and when at least part of Tb is grain boundary diffused, the concentration distribution decreasing from the outer side towards the inner side of the R-T-B based permanent magnet can be easily attained. Also, Tb may not be added at this point, and Tb may be added only at the time of the grain boundary diffusion which is described in below. In such case, the cost can be suppressed.

After preparing the raw material alloy, it is pulverized (pulverization step). Note that, an atmosphere of each step from the pulverization step to the sintering step can be a low oxygen concentration to obtain higher magnetic properties. For instance, the oxygen concentration in each step can be 200 ppm or less. By controlling the oxygen concentration in each step, an oxygen amount included in the R-T-B based permanent magnet can be controlled.

Below, as a pulverization step, a two-step process is described that includes a coarse pulverization step of pulverizing the alloy to a grain diameter of about several hundred μm, and a fine pulverization step of finely pulverizing the alloy to a grain diameter of several while a single-step process consisting solely of a fine pulverization step may be carried out.

In the coarse pulverization step, the raw material alloy is coarsely pulverized till the particle diameter becomes approximately several hundred μm to several mm. Thereby, the coarsely pulverized powder is obtained. The coarse pulverization can be carried out by any method, and it can be a known method such as a hydrogen storage pulverization method, a method using a coarse pulverizer, and the like. In case of performing the hydrogen storage pulverization, the nitrogen amount included in the R-T-B based permanent magnet can be controlled by controlling nitrogen gas concentration in atmosphere during the dehydrogenation treatment.

Next, the obtained coarsely pulverized powder is finely pulverized till the average particle diameter becomes approximately several μm (fine pulverization step). Thereby, a fine pulverized powder (raw material powder) is obtained.

The average particle diameter of the fine pulverized powder may be 1 μm or more and 10 μm or less, 2 μm or more and 6 μm or less, or 3 μm or more and 5 μm or less. The nitrogen amount included in the R-T-B based permanent magnet can be controlled by controlling the nitrogen gas concentration in an atmosphere during the fine pulverization step.

The fine pulverization can be carried out by any method. For instance, various kinds of fine pulverizers can be used for the fine pulverization.

When finely pulverizing the coarsely pulverized powder in the fine pulverization step, by adding various pulverization aids such as lauramide, oleyamide, and the like, the fine pulverized powder with high orientation when compacting can be obtained. In addition, the carbon amount included in the R-T-B based permanent magnet can be controlled by varying an amount of the pulverization aids added.

[Compacting Step]

In a compacting step, the fine pulverized powder is compacted to a desired shape. The compacting can be performed by any method. According to the present embodiment, the above fine pulverized powder is filled in a die and pressurized in a magnetic field. The green compact obtained as such has main phase crystals oriented in a specific direction. Therefore, the R-T-B based permanent magnet having higher residual magnetic flux density Br can be obtained.

The pressure during the compacting can be 20 MPa to 300 MPa. The magnetic field applied can be 950 kA/m or more, or 950 kA/m to 1600 kA/m. The magnetic field applied is not limited to a static magnetic field, and it can be a pulse magnetic field. Also, the static magnetic field and the pulse magnetic field can be used together.

As a compacting method, other than dry compacting wherein the fine pulverized powder is directly molded as described above, wet compacting can be applied wherein a slurry obtained by dispersing the fine pulverized powder in a solvent such as oil is molded.

A shape of the green compact obtained by compacting the fine pulverized powder can be any shape. In addition, the density of the green compact at this point can be 4.0 $Mg/m^3$ to 4.3 $Mg/m^3$.

[Sintering Step]

A sintering step is a step in which the green compact is sintered in a vacuum or inert gas atmosphere to obtain the sintered body. Although a sintering temperature needs to be adjusted depending on conditions such as composition, pulverization method, a difference of particle size and particle size distribution, and the like, sintering is carried out by heating the green compact for example in vacuum or under inert gas, at 1,000° C. or higher to 1,200° C. or less for one hour or more to 20 hours or less. Thereby, the sintered body with high density can be obtained. In the present embodiment, the sintered body having at least the density of 7.45 $Mg/m^3$ or more is obtained. The density of the sintered body can be 7.50 $Mg/m^3$ or more.

[Aging Treatment Step]

An aging treatment step is a step in which the sintered body is heat treated at lower temperature than the sintering temperature. There is no particular limitation whether or not to carry out the aging treatment step, and the number of carrying out the aging treatment step is also not particularly limited. The aging treatment step is performed accordingly depending on the desired magnetic properties. In addition, a grain boundary diffusion step which is described in below may be used as the aging treatment step. For the R-T-B based permanent magnet according to the present embodiment, two steps of the aging treatment are carried out. Hereinafter, the embodiment carrying out the two steps aging treatment is described.

A first-time aging step is referred to as a first aging step, a second-time aging step is referred to as a second aging step, the aging temperature of the first aging step is referred to as T1, and the aging temperature of the second aging step is referred to as T2.

The temperature T1 and the aging time during the first aging step are not particularly limited, and may be 700° C. or more and 900° C. or less for one hour to 10 hours.

The temperature T2 and the aging time during the second aging step are not particularly limited, and may be 500° C. or more and 700° C. or less for one hour to 10 hours.

By such aging treatments, the magnetic properties, especially the coercive force HcJ of the finally obtained R-T-B based permanent magnet can be improved.

Hereinafter, a method in which Tb is diffused along the grain boundaries in the R-T-B based permanent magnet of the present embodiment is described.

[Machining Step (Before the Grain Boundary Diffusion)]

Before the grain boundary diffusion, a step for machining the R-T-B based permanent magnet according to the present embodiment to a desired shape may be employed if necessary. As an example of the machining method, a shape machining such as cutting, grinding, and the like; and a chamfering such as barrel polishing and the like may be mentioned.

[Grain Boundary Diffusion Step]

A grain boundary diffusion is performed by heat treating after adhering the heavy rare earth metal (Tb in the present embodiment), a compound, alloy, and the like including the heavy rare earth element on the surface of the R-T-B based permanent magnet by coating, deposition, and the like. The coercive force HcJ of the finally obtained R-T-B based permanent magnet can be further enhanced by the grain boundary diffusion of the heavy rare earth element. As the heavy rare earth element which is diffused along the grain boundaries in the R-T-B based permanent magnet, Tb is preferable. It becomes possible to obtain a higher coercive force HcJ by using Tb.

In the embodiments hereinafter, a coating material such as slurry, paste, and the like which includes Tb is prepared, and the coating material is applied on the surface of the R-T-B based permanent magnet.

The coating material can be in any state. Any compound including Tb can be used, and any solvent or dispersant can be used. Further, the concentration of the heavy rare earth element in the coating material can be arbitrary concentration. As the compound including Tb, for example fluoride and hydride can be used.

A diffusion treatment temperature during the grain boundary diffusion step according to the present embodiment can be 800 to 950° C. The diffusion treatment time can be one hour to 50 hours. The grain boundary diffusion step may also serve as the aging treatment step described above.

By setting the diffusion treatment temperature and the diffusion treatment time as described above, the manufacturing cost can be kept low, and the concentration distribution of Tb can be easily made suitable.

An additional heat treatment may be performed after the grain boundary diffusion treatment. In this case, the heat treatment temperature may be 450 to 600° C. The heat treatment time can be one hour to 10 hours. The magnetic properties, especially the coercive force HcJ, of the finally obtained R-T-B based permanent magnet can be further enhanced by such heat treatment.

The production stability of the R-T-B based permanent magnet of the present embodiment can be confirmed by the difference of the magnetic properties due to the change of the aging temperature, the diffusion treatment temperature, or the heat treatment temperature after diffusion treatment. Hereinafter, the diffusion treatment step is described; however, the same applies to the aging temperature and the heat treatment temperature after the diffusion treatment.

For instance, in case the difference of magnetic properties due to the change of diffusion treatment temperature is large, the magnetic properties change even by a small change of the diffusion treatment temperature. Therefore, an acceptable range of the diffusion treatment temperature during the grain boundary diffusion step becomes narrow, and the production stability becomes low. On the contrary, in case the difference of magnetic properties due to the change of diffusion treatment temperature is small, the magnetic properties scarcely change even when the diffusion treatment temperature changes. Therefore, the acceptable range of the diffusion treatment temperature during the grain boundary diffusion step becomes wide and the production stability becomes high. Furthermore, it becomes possible to carry out the grain boundary diffusion at high temperature in short time, so the production cost can be reduced. [Machining Step (After the Grain Boundary Diffusion)]

Various kinds of the machining may be performed on the R-T-B based permanent magnet after the grain boundary diffusion step. The type of machining to be carried out is not particularly limited. For example, a shape machining such as cutting, grinding, and the like; and a chamfering such as barrel polishing and the like may be carried out.

The R-T-B based permanent magnet of the present embodiment obtained by the above method becomes an R-T-B based permanent magnet product by magnetizing.

Thus obtained R-T-B based permanent magnet of the present embodiment has desired properties. Specifically, the residual magnetic flux density Br and the coercive force HcJ are high, and the corrosion resistance and the production stability are superior.

The R-T-B based permanent magnet according to the present embodiment is suitably used for a motor, an electric generator, and the like.

Note that, the invention is not limited to the above described embodiment and can be variously modified within the scope of the invention.

While the R-T-B based permanent magnet can be obtained by the above method, the method for producing the R-T-B based permanent magnet is not limited to the above method, and may be suitably changed. For example, the R-T-B based permanent magnet of the present embodiment may be produced by hot working. A method for producing the R-T-B based permanent magnet by hot working includes the following steps:

(a) a melting and quenching step of melting raw material metals and quenching the resulting molten metal to obtain a ribbon;

(b) a pulverization step of pulverizing the ribbon to obtain a flake-like raw material powder;

(c) a cold forming step of cold-forming the pulverized raw material powder;

(d) a preheating step of preheating the cold-formed body;

(e) a hot forming step of hot-forming the preheated cold-formed body;

(f) a hot plastic deforming step of plastically deforming the hot-formed body into a predetermined shape; and (g) an aging treatment step of aging an R-T-B based permanent magnet.

Note that, the steps after the aging step is the same as the case of manufacturing by sintering.

EXAMPLE

Hereinafter, the R-T-B based permanent magnet of the present invention will be described in detail referring to examples; however, the invention is not limited thereto. In the examples described in below, an R-T-B based sintered magnet is described.

(Experiemnt 1)

(Manufacturing R-T-B Based Sintered Magnet)

Nd, Pr, alloy of Dy and Fe, an electrolytic iron, and a low carbon ferroboron alloy were prepared as raw materials. Further, Al, Ga, Cu, Co, Mn, and Zr were prepared as pure metal, or as an alloy with Fe.

The raw material alloy was prepared using a strip casting method to the above-mentioned raw materials in order to make the finally obtained magnet composition having the composition of each sample of Tables 1 to 3 shown in below. Also, the thickness of the raw material alloy was 0.2 mm to 0.4 mm. The contents (mass %) of elements other than C, N, and O shown in Tables 1 to 3 were values based on the total content of R, T, B, and M of 100 mass %.

Subsequently, hydrogen was absorbed into the raw material alloy by flowing hydrogen gas at room temperature for one hour. Then, the atmosphere was changed to Ar gas and the dehydrogenation treatment was performed at 600° C. for one hour to perform the hydrogen storage pulverization to the raw material alloy. Regarding sample numbers 130 to 132, the nitrogen gas concentration in the atmosphere during the dehydrogenation treatment was regulated to make the nitrogen content to a predetermined amount. Subsequently, after cooling, the dehydrogenation treated raw material alloys were sieved to obtain the powder having particle diameter of 425 μm or less. Note that, from the hydrogen storage pulverization step to the sintering step which will be described in below, the atmosphere was low oxygen atmosphere in which the oxygen concentration was consistently less than 200 ppm. Regarding sample numbers 124 to 127, the oxygen concentration was regulated to make the oxygen content to a predetermined amount.

Subsequently, a mass ratio of 0.1% oleyamide was added as the pulverization aid to the raw material alloy powder after the hydrogen storage pulverization and sieving, and then these were mixed. Regarding sample numbers 113 to 118, the amount of the pulverization aid added was regulated in order to make the carbon content to a predetermined amount.

Subsequently, the obtained powder was finely pulverized in a nitrogen gas stream using an impact plate type jet mill apparatus, and the fine powder (raw material powder) having an average particle diameter of 3.9 to 4.2 μm was obtained. Regarding samples 128 and 129, the obtained powder was finely pulverized in a mixed gas stream of Ar and nitrogen, and the nitrogen gas concentration was adjusted to make the nitrogen content to a predetermined amount. Note that, the average particle diameter was an average particle diameter D50 measured by a laser diffraction type particle size analyzer.

The obtained fine powder was compacted in the magnetic field and a green compact was manufactured. Here, the magnetic field applied to the obtained fine powder when compacting was a static magnetic field of 1,200 kA/m. The pressure applied during the compacting was 98 MPa. The direction of magnetic field application and the direction of pressurization were perpendicular to each other. The density of the green compact at this point was measured, and all of the green compacts had the density within 4.10 $Mg/m^3$ to 4.25 $Mg/m^3$.

Subsequently, the green compact was sintered and a sintered body was obtained. Optimum conditions of sintering vary depending on the composition and the like; however, sintering was carried out within the temperature range of 1,040° C. to 1,100° C. for four hours. Sintering was carried out in a vacuumed atmosphere. The sintered density at this point was within 7.45 $Mg/m^3$ to 7.55 $Mg/m^3$. Then, in Ar atmosphere under atmospheric pressure, the first aging treatment was performed at the first aging temperature T1=850° C. for one hour and the second aging treatment was further performed at the second aging temperature T2=520° C. for one hour.

Subsequently, the sintered body after aging treatment was ground to 14 mm×10 mm×4.2 mm (the thickness in the direction of easy axis of magnetization was 4.2 mm) by a vertical grinding machine, and the sintered body before the grain boundary diffusion of Tb described below was manufactured.

In addition, the sintered body obtained in the above step was etched by carrying out a set of treatments of immersing in a mixed solution of nitric acid and ethanol including 3 mass % of nitric acid relative to 100 mass % of ethanol for three minutes and then immersing in ethanol for one minute. The etching treatment of immersing for 3 minutes in the mixed solution and one minute in ethanol was repeated twice. Subsequently, a slurry having $TbH_2$ particles (average particle diameter D50=10.0 μm) dispersed in ethanol was applied on entire surface of the sintered body after the etching treatment so that a mass ratio of Tb with relative to a mass of the sintered magnet was 0.2 to 1.2 mass %. The amount of coating was varied so that the content of Tb was as shown in Tables 1 to 3.

After applying and drying the slurry, the diffusion treatment was performed in flowing Ar atmosphere (1 atm) at 930° C. for 18 hours, and then the heat treatment was performed at 520° C. for four hours. Then, the surfaces of the sample having 14 mm×10 mm×4.2 mm were ground by 0.1 mm per each face, and then the R-T-B based sintered magnet of each sample shown in Tables 1 to 3 were obtained.

The average composition of each obtained R-T-B based sintered magnet was measured. Each sample was pulverized by a stamp mill and analyzed. The amounts of various metal elements were measured by the X-ray fluorescence analysis. The content of boron (B) was measured by ICP analysis. The content of oxygen was measured by the inert gas fusion-nondispersive infrared absorption method. The content of carbon was measured by the combustion in oxygen stream-infrared absorption method. The content of nitrogen was measured by the inert gas fusion-thermal conductivity method. The compositions of each sample were confirmed to be as shown in Tables 1 to 3. The Fe content being balance (bal.) means that the contents of elements not listed in Tables 1 to 3 above were included in the Fe content, and the total of R, T, B, and M was 100 mass %. Also, in the present example, TRE, the total of R content, was 28.20 mass % or more and 30.50 mass % or less. The C, N, and O contents (ppm) shown in Tables 1 to 3 each indicated the contents based on the total mass of the magnet.

The obtained R-T-B based sintered magnet was ground and the magnetic properties were evaluated. The magnetic properties were evaluated after magnetizing by 4,000 kA/m pulse magnetic field. For the measurement of the residual magnetic flux density Br, each surface of the magnet was ground to form 13.8 mm×9.8 mm×4 mm, then three sintered magnets were layered one on top of the other, then the residual magnetic flux density Br was measured by a BH tracer. For the measurement of the coercive force HcJ, the entire surface of the magnet was evenly ground to form 7 mm×7 mm×4 mm, and using one magnet, the coercive force HcJ was measured by a pulse BH tracer. The sample which was used to evaluate the residual magnetic flux density Br and the sample which was used to evaluate the coercive force HcJ are different samples. Note that, the magnet was magnetized before the measurement by a pulse magnetic field of 4,000 kA/m. The results are shown in Tables 1 to 3.

Generally, the residual magnetic flux density Br and the coercive force HcJ are in the relationship of a trade-off. Namely, the coercive force HcJ tends to be low as the residual magnetic flux density Br is high, and the residual magnetic flux density Br tends to be low as the coercive force HcJ is high. Thus, for the present example, a performance index PI (Potential Index) was set to comprehensively evaluate the residual magnetic flux density Br and the coercive force HcJ. The following equation was defined where the magnitude of the residual magnetic flux density measured by mT unit was Br (mT), and the magnitude of the coercive force measured by kA/m unit was HcJ (kA/m).

$$PI=Br+25\times HcJ\times 4\pi/2{,}000$$

For the present example, when Br≥1230 mT, HcJ≥2150 kA/m, and PI≥1740 were satisfied, the residual magnetic flux density Br and the coercive force HcJ were considered good. Also, when the squareness ratio Hk/HcJ was 95.0% or more, it was considered good. Note that, the squareness ratio Hk/HcJ in the present example was calculated by Hk/HcJ when Hk (kA/m) was the magnitude of the magnetic field when the magnetization J reached 90% of Br in the second quadrant (J-H demagnetization curve) of a magnetization J-magnetic field H curve. Then, J-H curve was measured using a BH tracer at the measuring temperature of 200° C.; thereby the squareness ratio Hk/HcJ was calculated.

When a sample satisfied Br≥1230 mT, HcJ≥2150 kA/m, PI≥1740, and Hk/HcJ≥95.0%, such sample was considered good and it was shown by a symbol "○". If a sample did not satisfy any one of the above properties, then it was shown by a symbol of "x". Note that, HcJ≥2550 kA/m were even more preferable.

In addition, the corrosion resistance of each R-T-B based sintered magnet was tested. The corrosion resistance was tested by PCT test (Pressure Cooker Test) under saturated vapor pressure. Specifically, a mass change of the R-T-B based sintered magnet before and after the test under pressure of 2 atm for 1,000 hours in 100% RH atmosphere was measured. The corrosion resistance was considered good when the mass decrease per a total surface area of the magnet was 3 $mg/cm^2$ or less. The corrosion resistance was considered particularly good when the mass decrease was 2 $mg/cm^2$ or less. The samples showed the corrosion resistance of particularly good, good, and poor, which were shown by the symbols "◎", "○" and "x", respectively. Note that, none of the samples tested for the corrosion resistance showed "poor" for the corrosion resistance.

Further, for each sample, the demagnetization factor at high temperature was measured. First, the sample was ground into a shape having a permeance coefficient of 0.5. Then, the sample was magnetized by the pulse magnetic field of 4,000 kA/m, and the total magnetic flux amount of the sample at room temperature (23° C.) was measured. This was defined as B0. The total magnetic flux amount was for example measured by a flux meter and the like. Next, the sample was exposed under high temperature of 200° C. for 2 hours, and then turned back to room temperature. Once the temperature of the sample turned back to room temperature, the total residual magnetic flux was measured again, and this was defined as B1. When the demagnetization factor at high temperature was D (%), the following equation was satisfied.

$$D=100\times(B1-B0)/B0(\%)$$

When the absolute value of the demagnetization factor at high temperature was less than 1%, then it was considered good.

TABLE 1

| | R-T-B based sintered magnet composiiton (after Tb diffusion) | | | | | | | | |
|---|---|---|---|---|---|---|---|---|---|
| | R | | | | | | T | | |
| Sample No. | Nd (mass %) | Pr (mass %) | Tb (mass %) | Dy (mass %) | TRL (mass %) | TRE (mass %) | Co (mass %) | Fe (mass %) | B (mass %) |
| 1* | 20.40 | 6.80 | 0.35 | 3.30 | 27.20 | 30.85 | 2.0 | bal. | 0.96 |
| 2* | 20.40 | 6.80 | 0.35 | 3.30 | 27.20 | 30.85 | 2.0 | bal. | 0.95 |
| 3* | 20.40 | 6.80 | 0.35 | 3.30 | 27.20 | 30.85 | 2.0 | bal. | 0.94 |
| 4* | 20.40 | 6.80 | 0.35 | 3.30 | 27.20 | 30.85 | 2.0 | bal. | 0.93 |
| 5* | 20.40 | 6.80 | 0.35 | 3.30 | 27.20 | 30.85 | 2.0 | bal. | 0.90 |
| 6* | 20.40 | 6.80 | 0.35 | 3.30 | 27.20 | 30.85 | 2.0 | bal. | 0.88 |
| 7* | 20.40 | 6.80 | 0.35 | 3.30 | 27.20 | 30.85 | 2.0 | bal. | 0.85 |
| 8* | 20.10 | 6.70 | 0.35 | 3.30 | 26.80 | 30.45 | 2.0 | bal. | 0.96 |
| 9 | 20.10 | 6.70 | 0.35 | 3.30 | 26.80 | 30.45 | 2.0 | bal. | 0.95 |
| 10 | 20.10 | 6.70 | 0.35 | 3.30 | 26.80 | 30.45 | 2.0 | bal. | 0.94 |
| 11 | 20.10 | 6.70 | 0.35 | 3.30 | 26.80 | 30.45 | 2.0 | bal. | 0.93 |
| 12 | 20.10 | 6.70 | 0.35 | 3.30 | 26.80 | 30.45 | 2.0 | bal. | 0.90 |
| 13 | 20.10 | 6.70 | 0.35 | 3.30 | 26.80 | 30.45 | 2.0 | bal. | 0.88 |
| 14* | 19.70 | 6.60 | 0.35 | 3.30 | 26.30 | 29.95 | 2.0 | bal. | 0.96 |
| 15 | 19.70 | 6.60 | 0.35 | 3.30 | 26.30 | 29.95 | 2.0 | bal. | 0.95 |
| 16 | 19.70 | 6.60 | 0.35 | 3.30 | 26.30 | 29.95 | 2.0 | bal. | 0.94 |
| 17 | 19.70 | 6.60 | 0.35 | 3.30 | 26.30 | 29.95 | 2.0 | bal. | 0.93 |
| 18 | 19.70 | 6.60 | 0.35 | 3.30 | 26.30 | 29.95 | 2.0 | bal. | 0.90 |
| 19 | 19.70 | 6.60 | 0.35 | 3.30 | 26.30 | 29.95 | 2.0 | bal. | 0.88 |
| 20 | 19.70 | 6.60 | 0.35 | 3.30 | 26.30 | 29.95 | 2.0 | bal. | 0.85 |
| 21* | 19.30 | 6.50 | 0.35 | 3.30 | 25.80 | 29.45 | 2.0 | bal. | 0.96 |
| 22 | 19.30 | 6.50 | 0.35 | 3.30 | 25.80 | 29.45 | 2.0 | bal. | 0.95 |
| 23 | 19.30 | 6.50 | 0.35 | 3.30 | 25.80 | 29.45 | 2.0 | bal. | 0.94 |
| 24 | 19.30 | 6.50 | 0.35 | 3.30 | 25.80 | 29.45 | 2.0 | bal. | 0.93 |
| 25 | 19.30 | 6.50 | 0.35 | 3.30 | 25.80 | 29.45 | 2.0 | bal. | 0.90 |
| 26 | 19.30 | 6.50 | 0.35 | 3.30 | 25.80 | 29.45 | 2.0 | bal. | 0.88 |
| 27 | 19.30 | 6.50 | 0.35 | 3.30 | 25.80 | 29.45 | 2.0 | bal. | 0.85 |
| 28* | 19.10 | 6.40 | 0.35 | 3.30 | 25.50 | 29.15 | 2.0 | bal. | 0.96 |
| 29 | 19.10 | 6.40 | 0.35 | 3.30 | 25.50 | 29.15 | 2.0 | bal. | 0.95 |
| 30 | 19.10 | 6.40 | 0.35 | 3.30 | 25.50 | 29.15 | 2.0 | bal. | 0.94 |
| 31 | 19.10 | 6.40 | 0.35 | 3.30 | 25.50 | 29.15 | 2.0 | bal. | 0.93 |
| 32 | 19.10 | 6.40 | 0.35 | 3.30 | 25.50 | 29.15 | 2.0 | bal. | 0.90 |
| 33 | 19.10 | 6.40 | 0.35 | 3.30 | 25.50 | 29.15 | 2.0 | bal. | 0.88 |
| 34 | 19.10 | 6.40 | 0.35 | 3.30 | 25.50 | 29.15 | 2.0 | bal. | 0.85 |
| 35* | 18.40 | 6.20 | 0.35 | 3.30 | 24.60 | 28.25 | 2.0 | bal. | 0.96 |
| 36 | 18.40 | 6.20 | 0.35 | 3.30 | 24.60 | 28.25 | 2.0 | bal. | 0.95 |
| 37 | 18.40 | 6.20 | 0.35 | 3.30 | 24.60 | 28.25 | 2.0 | bal. | 0.94 |
| 38 | 18.40 | 6.20 | 0.35 | 3.30 | 24.60 | 28.25 | 2.0 | bal. | 0.93 |
| 39 | 18.40 | 6.20 | 0.35 | 3.30 | 24.60 | 28.25 | 2.0 | bal. | 0.90 |
| 40 | 18.40 | 6.20 | 0.35 | 3.30 | 24.60 | 28.25 | 2.0 | bal. | 0.88 |

| | R-T-B based sintered magnet composiiton (after Tb diffusion) | | | | | | | | |
|---|---|---|---|---|---|---|---|---|---|
| | | | M | | | | | | |
| Sample No. | TRE/B (atomic ratio) | 14B/(Fe + Co) (atomic ratio) | Al (mass %) | Ga (mass %) | Cu (mass %) | Mn (mass %) | Zr (mass %) | C (ppm) | N (ppm) |
| 1* | 2.39 | 1.03 | 0.20 | 0.20 | 0.20 | 0.03 | 0.15 | 900 | 500 |
| 2* | 2.42 | 1.02 | 0.20 | 0.20 | 0.20 | 0.03 | 0.15 | 900 | 500 |
| 3* | 2.44 | 1.01 | 0.20 | 0.20 | 0.20 | 0.03 | 0.15 | 900 | 500 |
| 4* | 2.47 | 1.00 | 0.20 | 0.20 | 0.20 | 0.03 | 0.15 | 900 | 500 |
| 5* | 2.55 | 0.97 | 0.20 | 0.20 | 0.20 | 0.03 | 0.15 | 900 | 500 |
| 6* | 2.61 | 0.94 | 0.20 | 0.20 | 0.20 | 0.03 | 0.15 | 900 | 500 |
| 7* | 2.70 | 0.91 | 0.20 | 0.20 | 0.20 | 0.03 | 0.15 | 900 | 500 |
| 8* | 2.36 | 1.03 | 0.20 | 0.20 | 0.20 | 0.03 | 0.15 | 900 | 500 |
| 9 | 2.38 | 1.01 | 0.20 | 0.20 | 0.20 | 0.03 | 0.15 | 900 | 500 |
| 10 | 2.41 | 1.00 | 0.20 | 0.20 | 0.20 | 0.03 | 0.15 | 900 | 500 |
| 11 | 2.43 | 0.99 | 0.20 | 0.20 | 0.20 | 0.03 | 0.15 | 900 | 500 |
| 12 | 2.52 | 0.96 | 0.20 | 0.20 | 0.20 | 0.03 | 0.15 | 900 | 500 |

TABLE 1-continued

| | | | | | | | | | |
|---|---|---|---|---|---|---|---|---|---|
| 13 | 2.57 | 0.94 | 0.20 | 0.20 | 0.20 | 0.03 | 0.15 | 900 | 500 |
| 14* | 2.32 | 1.02 | 0.20 | 0.20 | 0.20 | 0.03 | 0.15 | 900 | 500 |
| 15 | 2.34 | 1.01 | 0.20 | 0.20 | 0.20 | 0.03 | 0.15 | 900 | 500 |
| 16 | 2.37 | 1.00 | 0.20 | 0.20 | 0.20 | 0.03 | 0.15 | 900 | 500 |
| 17 | 2.39 | 0.99 | 0.20 | 0.20 | 0.20 | 0.03 | 0.15 | 900 | 500 |
| 18 | 2.47 | 0.95 | 0.20 | 0.20 | 0.20 | 0.03 | 0.15 | 900 | 500 |
| 19 | 2.53 | 0.93 | 0.20 | 0.20 | 0.20 | 0.03 | 0.15 | 900 | 500 |
| 20 | 2.62 | 0.90 | 0.20 | 0.20 | 0.20 | 0.03 | 0.15 | 900 | 500 |
| 21* | 2.28 | 1.01 | 0.20 | 0.20 | 0.20 | 0.03 | 0.15 | 900 | 500 |
| 22 | 2.30 | 1.00 | 0.20 | 0.20 | 0.20 | 0.03 | 0.15 | 900 | 500 |
| 23 | 2.33 | 0.99 | 0.20 | 0.20 | 0.20 | 0.03 | 0.15 | 900 | 500 |
| 24 | 2.35 | 0.98 | 0.20 | 0.20 | 0.20 | 0.03 | 0.15 | 900 | 500 |
| 25 | 2.43 | 0.95 | 0.20 | 0.20 | 0.20 | 0.03 | 0.15 | 900 | 500 |
| 26 | 2.49 | 0.93 | 0.20 | 0.20 | 0.20 | 0.03 | 0.15 | 900 | 500 |
| 27 | 2.58 | 0.89 | 0.20 | 0.20 | 0.20 | 0.03 | 0.15 | 900 | 500 |
| 28* | 2.26 | 1.01 | 0.20 | 0.20 | 0.20 | 0.03 | 0.15 | 900 | 500 |
| 29 | 2.28 | 1.00 | 0.20 | 0.20 | 0.20 | 0.03 | 0.15 | 900 | 500 |
| 30 | 2.30 | 0.99 | 0.20 | 0.20 | 0.20 | 0.03 | 0.15 | 900 | 500 |
| 31 | 2.33 | 0.97 | 0.20 | 0.20 | 0.20 | 0.03 | 0.15 | 900 | 500 |
| 32 | 2.41 | 0.94 | 0.20 | 0.20 | 0.20 | 0.03 | 0.15 | 900 | 500 |
| 33 | 2.46 | 0.92 | 0.20 | 0.20 | 0.20 | 0.03 | 0.15 | 900 | 500 |
| 34 | 2.55 | 0.89 | 0.20 | 0.20 | 0.20 | 0.03 | 0.15 | 900 | 500 |
| 35* | 2.19 | 0.99 | 0.20 | 0.20 | 0.20 | 0.03 | 0.15 | 900 | 500 |
| 36 | 2.21 | 0.98 | 0.20 | 0.20 | 0.20 | 0.03 | 0.15 | 900 | 500 |
| 37 | 2.23 | 0.97 | 0.20 | 0.20 | 0.20 | 0.03 | 0.15 | 900 | 500 |
| 38 | 2.26 | 0.96 | 0.20 | 0.20 | 0.20 | 0.03 | 0.15 | 900 | 500 |
| 39 | 2.33 | 0.93 | 0.20 | 0.20 | 0.20 | 0.03 | 0.15 | 900 | 500 |
| 40 | 2.38 | 0.91 | 0.20 | 0.20 | 0.20 | 0.03 | 0.15 | 900 | 500 |

| | R-T-B based sintered magnet composiiton (after Tb diffusion) | | | | | | | | |
|---|---|---|---|---|---|---|---|---|---|
| Sample No. | O (ppm) | Tb/C (atomic ratio) | Br (mT) | HcJ (kA/m) | PI | Hk/HcJ (%) | PI, Hk/HcJ Evaluation | Demagnetization factor at high temperature (%) | Corrosion resistance |
| 1* | 500 | 0.29 | 1331 | 2513 | 1726 | 92.1 | X | 0 | ○ |
| 2* | 500 | 0.29 | 1334 | 2526 | 1731 | 97.8 | X | 0 | ○ |
| 3* | 500 | 0.29 | 1331 | 2551 | 1732 | 97.8 | X | 0 | ○ |
| 4* | 500 | 0.29 | 1328 | 2561 | 1730 | 97.8 | X | 0 | ○ |
| 5* | 500 | 0.29 | 1329 | 2564 | 1732 | 97.3 | X | 0 | ○ |
| 6* | 500 | 0.29 | 1326 | 2574 | 1730 | 97.8 | X | 0 | ○ |
| 7* | 500 | 0.29 | 1314 | 2516 | 1709 | 97.2 | X | 0 | ○ |
| 8* | 500 | 0.29 | 1344 | 2520 | 1740 | 86.5 | X | 0 | ◎ |
| 9 | 500 | 0.29 | 1343 | 2528 | 1740 | 98.0 | ○ | 0 | ◎ |
| 10 | 500 | 0.29 | 1344 | 2545 | 1744 | 98.5 | ○ | 0 | ◎ |
| 11 | 500 | 0.29 | 1341 | 2549 | 1741 | 98.7 | ○ | 0 | ◎ |
| 12 | 500 | 0.29 | 1337 | 2575 | 1741 | 98.3 | ○ | 0 | ◎ |
| 13 | 500 | 0.29 | 1338 | 2562 | 1740 | 98.3 | ○ | 0 | ◎ |
| 14* | 500 | 0.29 | 1362 | 2501 | 1755 | 85.9 | X | 0 | ◎ |
| 15 | 500 | 0.29 | 1362 | 2515 | 1757 | 98.1 | ○ | 0 | ◎ |
| 16 | 500 | 0.29 | 1362 | 2547 | 1762 | 98.1 | ○ | 0 | ◎ |
| 17 | 500 | 0.29 | 1362 | 2550 | 1763 | 98.1 | ○ | 0 | ◎ |
| 18 | 500 | 0.29 | 1358 | 2573 | 1762 | 98.0 | ○ | 0 | ◎ |
| 19 | 500 | 0.29 | 1356 | 2566 | 1759 | 98.1 | ○ | 0 | ◎ |
| 20 | 500 | 0.29 | 1344 | 2528 | 1741 | 98.0 | ○ | 0 | ◎ |
| 21* | 500 | 0.29 | 1376 | 2467 | 1764 | 83.2 | X | 0 | ◎ |
| 22 | 500 | 0.29 | 1373 | 2494 | 1765 | 97.8 | ○ | 0 | ◎ |
| 23 | 500 | 0.29 | 1373 | 2508 | 1767 | 98.8 | ○ | 0 | ◎ |
| 24 | 500 | 0.29 | 1371 | 2524 | 1767 | 99.1 | ○ | 0 | ◎ |
| 25 | 500 | 0.29 | 1364 | 2548 | 1764 | 99.0 | ○ | 0 | ◎ |
| 26 | 500 | 0.29 | 1363 | 2548 | 1763 | 98.9 | ○ | 0 | ◎ |
| 27 | 500 | 0.29 | 1352 | 2480 | 1742 | 97.8 | ○ | 0 | ◎ |
| 28* | 500 | 0.29 | 1372 | 2452 | 1757 | 89.4 | X | 0 | ◎ |
| 29 | 500 | 0.29 | 1377 | 2466 | 1764 | 97.7 | ○ | 0 | ◎ |
| 30 | 500 | 0.29 | 1379 | 2482 | 1769 | 97.2 | ○ | 0 | ◎ |
| 31 | 500 | 0.29 | 1376 | 2512 | 1771 | 97.3 | ○ | 0 | ◎ |
| 32 | 500 | 0.29 | 1372 | 2526 | 1769 | 95.7 | ○ | 0 | ◎ |
| 33 | 500 | 0.29 | 1370 | 2524 | 1766 | 96.0 | ○ | 0 | ◎ |
| 34 | 500 | 0.29 | 1360 | 2472 | 1748 | 95.5 | ○ | 0 | ◎ |
| 35* | 500 | 0.29 | 1368 | 2372 | 1741 | 89.1 | X | 0 | ◎ |
| 36 | 500 | 0.29 | 1374 | 2397 | 1751 | 99.0 | ○ | 0 | ◎ |
| 37 | 500 | 0.29 | 1369 | 2412 | 1748 | 98.4 | ○ | 0 | ◎ |
| 38 | 500 | 0.29 | 1365 | 2445 | 1749 | 98.5 | ○ | 0 | ◎ |
| 39 | 500 | 0.29 | 1368 | 2447 | 1752 | 98.2 | ○ | 0 | ◎ |
| 40 | 500 | 0.29 | 1366 | 2428 | 1747 | 98.0 | ○ | 0 | ◎ |

TABLE 2

| | R-T-B based sintered magnet composition (after Tb diffusion) | | | | | | | | | |
|---|---|---|---|---|---|---|---|---|---|---|
| | R | | | | | | T | | | |
| Sample No. | Nd (mass %) | Pr (mass %) | Tb (mass %) | Dy (mass %) | TRL (mass %) | TRE (mass %) | Co (mass %) | Fe (mass %) | B (mass %) | TRE/B (atomic ratio) |
| *41 | 16.60 | 5.50 | 0.35 | 7.50 | 22.10 | 29.95 | 2.0 | bal. | 0.90 | 2.43 |
| 42 | 17.30 | 5.80 | 0.35 | 6.50 | 23.10 | 29.95 | 2.0 | bal. | 0.90 | 2.44 |
| 43 | 17.70 | 5.90 | 0.35 | 6.00 | 23.60 | 29.95 | 2.0 | bal. | 0.90 | 2.45 |
| 44 | 18.10 | 6.00 | 0.35 | 5.50 | 24.10 | 29.95 | 2.0 | bal. | 0.90 | 2.45 |
| 45 | 18.40 | 6.20 | 0.35 | 5.00 | 24.60 | 29.95 | 2.0 | bal. | 0.90 | 2.46 |
| 46 | 18.80 | 6.30 | 0.35 | 4.50 | 25.10 | 29.95 | 2.0 | bal. | 0.90 | 2.46 |
| 47 | 19.20 | 6.40 | 0.35 | 4.00 | 25.60 | 29.95 | 2.0 | bal. | 0.90 | 2.47 |
| 48 | 19.60 | 6.50 | 0.35 | 3.50 | 26.10 | 29.95 | 2.0 | bal. | 0.90 | 2.47 |
| 49 | 20.00 | 6.60 | 0.35 | 3.00 | 26.60 | 29.95 | 2.0 | bal. | 0.90 | 2.48 |
| 50 | 20.30 | 6.80 | 0.35 | 2.50 | 27.10 | 29.95 | 2.0 | bal. | 0.90 | 2.48 |
| 51 | 21.40 | 7.20 | 0.35 | 1.00 | 28.60 | 29.95 | 2.0 | bal. | 0.90 | 2.50 |
| *52 | 21.80 | 7.30 | 0.35 | 0.50 | 29.10 | 29.95 | 2.0 | bal. | 0.90 | 2.50 |
| *53 | 17.00 | 5.60 | 0.35 | 7.50 | 22.60 | 30.45 | 2.0 | bal. | 0.90 | 2.47 |
| 54 | 17.70 | 5.90 | 0.35 | 6.50 | 23.60 | 30.45 | 2.0 | bal. | 0.90 | 2.48 |
| 55 | 18.10 | 6.00 | 0.35 | 6.00 | 24.10 | 30.45 | 2.0 | bal. | 0.90 | 2.49 |
| 56 | 18.50 | 6.10 | 0.35 | 5.50 | 24.60 | 30.45 | 2.0 | bal. | 0.90 | 2.49 |
| 57 | 18.80 | 6.30 | 0.35 | 5.00 | 25.10 | 30.45 | 2.0 | bal. | 0.90 | 2.50 |
| 58 | 19.20 | 6.40 | 0.35 | 4.50 | 25.60 | 30.45 | 2.0 | bal. | 0.90 | 2.50 |
| 59 | 19.60 | 6.50 | 0.35 | 4.00 | 26.10 | 30.45 | 2.0 | bal. | 0.90 | 2.51 |
| 60 | 20.00 | 6.60 | 0.35 | 3.50 | 26.60 | 30.45 | 2.0 | bal. | 0.90 | 2.51 |
| 61 | 20.30 | 6.80 | 0.35 | 3.00 | 27.10 | 30.45 | 2.0 | bal. | 0.90 | 2.52 |
| 62 | 20.70 | 6.90 | 0.35 | 2.50 | 27.60 | 30.45 | 2.0 | bal. | 0.90 | 2.52 |
| 63 | 21.80 | 7.30 | 0.35 | 1.00 | 29.10 | 30.45 | 2.0 | bal. | 0.90 | 2.54 |
| *64 | 22.20 | 7.40 | 0.35 | 0.50 | 29.60 | 30.45 | 2.0 | bal. | 0.90 | 2.54 |
| *65 | 15.70 | 5.20 | 0.35 | 7.00 | 20.90 | 28.25 | 2.0 | bal. | 0.90 | 2.29 |
| 65 | 16.10 | 5.30 | 0.35 | 6.50 | 21.40 | 28.25 | 2.0 | bal. | 0.90 | 2.30 |
| 67 | 16.40 | 5.50 | 0.35 | 6.00 | 21.90 | 28.25 | 2.0 | bal. | 0.90 | 2.30 |
| 68 | 16.80 | 5.60 | 0.35 | 5.50 | 22.40 | 28.25 | 2.0 | bal. | 0.90 | 2.31 |
| 69 | 17.20 | 5.70 | 0.35 | 5.00 | 22.90 | 28.25 | 2.0 | bal. | 0.90 | 2.31 |
| 70 | 17.60 | 5.80 | 0.35 | 4.50 | 23.40 | 28.25 | 2.0 | bal. | 0.90 | 2.32 |
| 71 | 17.90 | 6.00 | 0.35 | 4.00 | 23.90 | 28.25 | 2.0 | bal. | 0.90 | 2.32 |
| 72 | 18.30 | 6.10 | 0.35 | 3.50 | 24.40 | 28.25 | 2.0 | bal. | 0.90 | 2.33 |
| 73 | 18.70 | 6.20 | 0.35 | 3.00 | 24.90 | 28.25 | 2.0 | bal. | 0.90 | 2.33 |
| 74 | 19.10 | 6.30 | 0.35 | 2.50 | 25.40 | 28.25 | 2.0 | bal. | 0.90 | 2.34 |
| *75 | 20.60 | 6.80 | 0.35 | 0.50 | 27.40 | 28.25 | 2.0 | bal. | 0.90 | 2.36 |
| *76 | 15.70 | 5.20 | 0.35 | 7.50 | 20.90 | 28.75 | 2.0 | bal. | 0.90 | 2.33 |
| 77 | 16.40 | 5.50 | 0.35 | 6.50 | 21.90 | 28.75 | 2.0 | bal. | 0.90 | 2.34 |
| 78 | 16.80 | 5.60 | 0.35 | 6.00 | 22.40 | 28.75 | 2.0 | bal. | 0.90 | 2.35 |
| 79 | 17.20 | 5.70 | 0.35 | 5.50 | 22.90 | 28.75 | 2.0 | bal. | 0.90 | 2.35 |
| 80 | 17.60 | 5.80 | 0.35 | 5.00 | 23.40 | 28.75 | 2.0 | bal. | 0.90 | 2.36 |
| 81 | 17.90 | 6.00 | 0.35 | 4.50 | 23.90 | 28.75 | 2.0 | bal. | 0.90 | 2.36 |
| 82 | 18.30 | 6.10 | 0.35 | 4.00 | 24.40 | 28.75 | 2.0 | bal. | 0.90 | 2.37 |
| 83 | 18.70 | 6.20 | 0.35 | 3.50 | 24.90 | 28.75 | 2.0 | bal. | 0.90 | 2.37 |
| 84 | 19.10 | 6.30 | 0.35 | 3.00 | 25.40 | 28.75 | 2.0 | bal. | 0.90 | 2.38 |
| 85 | 19.40 | 6.50 | 0.35 | 2.50 | 25.90 | 28.75 | 2.0 | bal. | 0.90 | 2.38 |
| *86 | 20.90 | 7.00 | 0.35 | 0.50 | 27.90 | 28.75 | 2.0 | bal. | 0.90 | 2.40 |

| | R-T-B based sintered magnet composition (after Tb diffusion) | | | | | | | | | |
|---|---|---|---|---|---|---|---|---|---|---|
| | 14B/ | M | | | | | | | | |
| Sample No. | (Fe + Co) (atomic ratio) | Al (mass %) | Ga (mass %) | Cu (mass %) | Mn (mass %) | Zr (mass %) | C (ppm) | N (ppm) | O (ppm) | Tb/C (atomic ratio) |
| *41 | 0.95 | 0.20 | 0.20 | 0.20 | 0.03 | 0.15 | 900 | 500 | 500 | 0.29 |
| 42 | 0.95 | 0.20 | 0.20 | 0.20 | 0.03 | 0.15 | 900 | 500 | 500 | 0.29 |
| 43 | 0.95 | 0.20 | 0.20 | 0.20 | 0.03 | 0.15 | 900 | 500 | 500 | 0.29 |
| 44 | 0.95 | 0.20 | 0.20 | 0.20 | 0.03 | 0.15 | 900 | 500 | 500 | 0.29 |
| 45 | 0.95 | 0.20 | 0.20 | 0.20 | 0.03 | 0.15 | 900 | 500 | 500 | 0.29 |
| 46 | 0.95 | 0.20 | 0.20 | 0.20 | 0.03 | 0.15 | 900 | 500 | 500 | 0.29 |
| 47 | 0.95 | 0.20 | 0.20 | 0.20 | 0.03 | 0.15 | 900 | 500 | 500 | 0.29 |
| 48 | 0.95 | 0.20 | 0.20 | 0.20 | 0.03 | 0.15 | 900 | 500 | 500 | 0.29 |
| 49 | 0.95 | 0.20 | 0.20 | 0.20 | 0.03 | 0.15 | 900 | 500 | 500 | 0.29 |
| 50 | 0.95 | 0.20 | 0.20 | 0.20 | 0.03 | 0.15 | 900 | 500 | 500 | 0.29 |
| 51 | 0.95 | 0.20 | 0.20 | 0.20 | 0.03 | 0.15 | 900 | 500 | 500 | 0.29 |
| *52 | 0.95 | 0.20 | 0.20 | 0.20 | 0.03 | 0.15 | 900 | 500 | 500 | 0.29 |
| *53 | 0.96 | 0.20 | 0.20 | 0.20 | 0.03 | 0.15 | 900 | 500 | 500 | 0.29 |
| 54 | 0.96 | 0.20 | 0.20 | 0.20 | 0.03 | 0.15 | 900 | 500 | 500 | 0.29 |
| 55 | 0.96 | 0.20 | 0.20 | 0.20 | 0.03 | 0.15 | 900 | 500 | 500 | 0.29 |
| 56 | 0.96 | 0.20 | 0.20 | 0.20 | 0.03 | 0.15 | 900 | 500 | 500 | 0.29 |
| 57 | 0.96 | 0.20 | 0.20 | 0.20 | 0.03 | 0.15 | 900 | 500 | 500 | 0.29 |
| 58 | 0.96 | 0.20 | 0.20 | 0.20 | 0.03 | 0.15 | 900 | 500 | 500 | 0.29 |
| 59 | 0.96 | 0.20 | 0.20 | 0.20 | 0.03 | 0.15 | 900 | 500 | 500 | 0.29 |

TABLE 2-continued

| | | | | | | | | | | |
|---|---|---|---|---|---|---|---|---|---|---|
| 60 | 0.96 | 0.20 | 0.20 | 0.20 | 0.03 | 0.15 | 900 | 500 | 500 | 0.29 |
| 61 | 0.96 | 0.20 | 0.20 | 0.20 | 0.03 | 0.15 | 900 | 500 | 500 | 0.29 |
| 62 | 0.96 | 0.20 | 0.20 | 0.20 | 0.03 | 0.15 | 900 | 500 | 500 | 0.29 |
| 63 | 0.96 | 0.20 | 0.20 | 0.20 | 0.03 | 0.15 | 900 | 500 | 500 | 0.29 |
| *64 | 0.96 | 0.20 | 0.20 | 0.20 | 0.03 | 0.15 | 900 | 500 | 500 | 0.29 |
| *65 | 0.93 | 0.20 | 0.20 | 0.20 | 0.03 | 0.15 | 900 | 500 | 500 | 0.29 |
| 65 | 0.93 | 0.20 | 0.20 | 0.20 | 0.03 | 0.15 | 900 | 500 | 500 | 0.29 |
| 67 | 0.93 | 0.20 | 0.20 | 0.20 | 0.03 | 0.15 | 900 | 500 | 500 | 0.29 |
| 68 | 0.93 | 0.20 | 0.20 | 0.20 | 0.03 | 0.15 | 900 | 500 | 500 | 0.29 |
| 69 | 0.93 | 0.20 | 0.20 | 0.20 | 0.03 | 0.15 | 900 | 500 | 500 | 0.29 |
| 70 | 0.93 | 0.20 | 0.20 | 0.20 | 0.03 | 0.15 | 900 | 500 | 500 | 0.29 |
| 71 | 0.93 | 0.20 | 0.20 | 0.20 | 0.03 | 0.15 | 900 | 500 | 500 | 0.29 |
| 72 | 0.93 | 0.20 | 0.20 | 0.20 | 0.03 | 0.15 | 900 | 500 | 500 | 0.29 |
| 73 | 0.93 | 0.20 | 0.20 | 0.20 | 0.03 | 0.15 | 900 | 500 | 500 | 0.29 |
| 74 | 0.93 | 0.20 | 0.20 | 0.20 | 0.03 | 0.15 | 900 | 500 | 500 | 0.29 |
| *75 | 0.93 | 0.20 | 0.20 | 0.20 | 0.03 | 0.15 | 900 | 500 | 500 | 0.29 |
| *76 | 0.94 | 0.20 | 0.20 | 0.20 | 0.03 | 0.15 | 900 | 500 | 500 | 0.29 |
| 77 | 0.94 | 0.20 | 0.20 | 0.20 | 0.03 | 0.15 | 900 | 500 | 500 | 0.29 |
| 78 | 0.94 | 0.20 | 0.20 | 0.20 | 0.03 | 0.15 | 900 | 500 | 500 | 0.29 |
| 79 | 0.94 | 0.20 | 0.20 | 0.20 | 0.03 | 0.15 | 900 | 500 | 500 | 0.29 |
| 80 | 0.94 | 0.20 | 0.20 | 0.20 | 0.03 | 0.15 | 900 | 500 | 500 | 0.29 |
| 81 | 0.94 | 0.20 | 0.20 | 0.20 | 0.03 | 0.15 | 900 | 500 | 500 | 0.29 |
| 82 | 0.94 | 0.20 | 0.20 | 0.20 | 0.03 | 0.15 | 900 | 500 | 500 | 0.29 |
| 83 | 0.94 | 0.20 | 0.20 | 0.20 | 0.03 | 0.15 | 900 | 500 | 500 | 0.29 |
| 84 | 0.94 | 0.20 | 0.20 | 0.20 | 0.03 | 0.15 | 900 | 500 | 500 | 0.29 |
| 85 | 0.94 | 0.20 | 0.20 | 0.20 | 0.03 | 0.15 | 900 | 500 | 500 | 0.29 |
| *86 | 0.94 | 0.20 | 0.20 | 0.20 | 0.03 | 0.15 | 900 | 500 | 500 | 0.29 |

| | R-T-B based sintered magnet composition (after Tb diffusion) | | | | | | |
|---|---|---|---|---|---|---|---|
| Sample No. | Br (mT) | HcJ (kA/m) | R | Hk/HcJ (%) | PI, Hk/HcJ Evaluation | Demagnetization factor at high temperature (%) | Corrosion resistance |
| *41 | 1227 | 3335 | 1751 | 96.8 | ○ | 0 | ◎ |
| 42 | 1258 | 3133 | 1750 | 98.8 | ○ | 0 | ◎ |
| 43 | 1272 | 3078 | 1755 | 97.7 | ○ | 0 | ◎ |
| 44 | 1289 | 2964 | 1755 | 98.6 | ○ | 0 | ◎ |
| 45 | 1306 | 2883 | 1759 | 95.6 | ○ | 0 | ◎ |
| 46 | 1320 | 2769 | 1755 | 99.2 | ○ | 0 | ◎ |
| 47 | 1332 | 2694 | 1755 | 97.3 | ○ | 0 | ◎ |
| 48 | 1352 | 2618 | 1763 | 98.1 | ○ | 0 | ◎ |
| 49 | 1367 | 2540 | 1766 | 96.7 | ○ | 0 | ◎ |
| 50 | 1381 | 2439 | 1764 | 98.4 | ○ | 0 | ◎ |
| 51 | 1427 | 2177 | 1769 | 98.5 | ○ | −6 | ◎ |
| *52 | 1443 | 2104 | 1773 | 97.8 | ○ | −11 | ○ |
| *53 | 1209 | 3343 | 1734 | 98.3 | X | 0 | ◎ |
| 54 | 1241 | 3186 | 1741 | 97.6 | ○ | 0 | ◎ |
| 55 | 1259 | 3067 | 1741 | 96.8 | ○ | 0 | ◎ |
| 56 | 1273 | 2997 | 1744 | 98.5 | ○ | 0 | ◎ |
| 57 | 1290 | 2901 | 1746 | 97.9 | ○ | 0 | ◎ |
| 58 | 1302 | 2792 | 1741 | 96.8 | ○ | 0 | ◎ |
| 59 | 1321 | 2713 | 1747 | 99.5 | ○ | 0 | ◎ |
| 60 | 1333 | 2625 | 1745 | 98.1 | ○ | 0 | ◎ |
| 61 | 1351 | 2509 | 1745 | 96.8 | ○ | 0 | ◎ |
| 62 | 1366 | 2442 | 1750 | 98.9 | ○ | 0 | ◎ |
| 63 | 1413 | 2161 | 1752 | 97.6 | ○ | −7 | ◎ |
| *64 | 1427 | 2068 | 1752 | 97.5 | ○ | −13 | ○ |
| *65 | 1253 | 3084 | 1737 | 99.4 | X | 0 | ◎ |
| 65 | 1267 | 3024 | 1742 | 97.7 | ○ | 0 | ◎ |
| 67 | 1283 | 2916 | 1741 | 99.5 | ○ | 0 | ◎ |
| 68 | 1296 | 2832 | 1741 | 98.5 | ○ | 0 | ◎ |
| 69 | 1316 | 2709 | 1742 | 98.5 | ○ | 0 | ◎ |
| 70 | 1328 | 2640 | 1743 | 97.9 | ○ | 0 | ◎ |
| 71 | 1347 | 2553 | 1748 | 99.5 | ○ | 0 | ◎ |
| 72 | 1361 | 2455 | 1747 | 98.1 | ○ | 0 | ◎ |
| 73 | 1373 | 2358 | 1743 | 96.7 | ○ | 0 | ◎ |
| 74 | 1391 | 2273 | 1748 | 99.2 | ○ | 0 | ◎ |
| *75 | 1454 | 1907 | 1754 | 99.0 | ○ | −24 | ○ |
| *76 | 1233 | 3219 | 1739 | 98.5 | X | 0 | ◎ |
| 77 | 1264 | 3041 | 1742 | 96.7 | ○ | 0 | ◎ |
| 78 | 1281 | 2951 | 1745 | 97.0 | ○ | 0 | ◎ |
| 79 | 1295 | 2875 | 1747 | 98.4 | ○ | 0 | ◎ |
| 80 | 1313 | 2759 | 1746 | 96.9 | ○ | 0 | ◎ |
| 81 | 1325 | 2670 | 1744 | 97.5 | ○ | 0 | ◎ |
| 82 | 1343 | 2615 | 1754 | 98.8 | ○ | 0 | ◎ |
| 83 | 1358 | 2493 | 1750 | 98.1 | ○ | 0 | ◎ |

TABLE 2-continued

| | | | | | | | |
|---|---|---|---|---|---|---|---|
| 84 | 1371 | 2409 | 1749 | 97.5 | ○ | 0 | ◎ |
| 85 | 1387 | 2318 | 1751 | 98.8 | ○ | 0 | ◎ |
| *86 | 1451 | 1970 | 1760 | 97.3 | ○ | −20 | ○ |

TABLE 3

| | R-T-B based sintered magnet composition (after Tb diffusion) | | | | | | | |
|---|---|---|---|---|---|---|---|---|
| | R | | | | | | T | |
| Sample No. | Nd (mass %) | Pr (mass %) | Tb (mass %) | Dy (mass %) | TRL (mass %) | TRE (mass %) | Co (mass %) | Fe (mass %) |
| 91 | 19.70 | 6.60 | 0.35 | 3.30 | 26.30 | 29.95 | 0.5 | bal. |
| 92 | 19.70 | 6.60 | 0.35 | 3.30 | 26.30 | 29.95 | 1.0 | bal. |
| 17 | 19.70 | 6.60 | 0.35 | 3.30 | 26.30 | 29.95 | 2.0 | bal. |
| 94 | 19.70 | 6.60 | 0.35 | 3.30 | 26.30 | 29.95 | 3.0 | bal. |
| 95 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 97 | 19.70 | 6.60 | 0.35 | 3.30 | 26.30 | 29.95 | 2.0 | bal. |
| 98 | 19.70 | 6.60 | 0.35 | 3.30 | 26.30 | 29.95 | 2.0 | bal. |
| 99 | 19.70 | 6.60 | 0.35 | 3.30 | 26.30 | 29.95 | 2.0 | bal. |
| 100 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 102 | 19.70 | 6.60 | 0.35 | 3.30 | 26.30 | 29.95 | 2.0 | bal. |
| 103 | 19.70 | 6.60 | 0.35 | 3.30 | 26.30 | 29.95 | 2.0 | bal. |
| 104 | 19.70 | 6.60 | 0.35 | 3.30 | 26.30 | 29.95 | 2.0 | bal. |
| 105 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 106 | 19.70 | 6.60 | 0.35 | 3.30 | 26.30 | 29.95 | 2.0 | bal. |
| 107 | 19.70 | 6.60 | 0.35 | 3.30 | 26.30 | 29.95 | 2.0 | bal. |
| 109 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 111 | 19.70 | 6.60 | 0.35 | 3.30 | 26.30 | 29.95 | 2.0 | bal. |
| 112 | 19.70 | 6.60 | 0.35 | 3.30 | 26.30 | 29.95 | 2.0 | bal. |
| 113 | 19.70 | 6.60 | 0.35 | 3.30 | 26.30 | 29.95 | 2.0 | bal. |
| 114 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 115 | 19.70 | 6.60 | 0.35 | 3.30 | 26.30 | 29.95 | 2.0 | bal. |
| 116 | 19.70 | 6.60 | 0.35 | 3.30 | 26.30 | 29.95 | 2.0 | bal. |
| 117 | 19.70 | 6.60 | 0.30 | 3.30 | 26.30 | 29.90 | 2.0 | bal. |
| 118 | 19.70 | 6.60 | 0.50 | 3.30 | 26.30 | 30.10 | 2.0 | bal. |
| 119 | 19.70 | 6.60 | 0.15 | 3.30 | 26.30 | 29.75 | 2.0 | bal. |
| 120 | 19.70 | 6.60 | 0.20 | 3.30 | 26.30 | 29.80 | 2.0 | bal. |
| 121 | 19.70 | 6.60 | 0.50 | 3.30 | 26.30 | 30.10 | 2.0 | bal. |
| 121a | 19.70 | 6.60 | 0.75 | 3.30 | 26.30 | 30.35 | 2.0 | bal. |
| 122 | 20.00 | 6.70 | 0.50 | 3.30 | 26.70 | 30.50 | 2.0 | bal. |
| 123 | 18.40 | 6.20 | 0.30 | 3.30 | 24.60 | 28.20 | 2.0 | bal. |
| 124 | 19.70 | 6.60 | 0.35 | 3.30 | 26.30 | 29.95 | 2.0 | bal. |
| 125 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 126 | 19.70 | 6.60 | 0.35 | 3.30 | 26.30 | 29.95 | 2.0 | bal. |
| 127 | 19.70 | 6.60 | 0.35 | 3.30 | 26.30 | 29.95 | 2.0 | bal. |
| 128 | 19.70 | 6.60 | 0.35 | 3.30 | 26.30 | 29.95 | 2.0 | bal. |
| 129 | 19.70 | 6.60 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 130 | 19.70 | 6.60 | 0.35 | 3.30 | 26.30 | 29.95 | 2.0 | bal. |
| 131 | 19.70 | 6.60 | 0.35 | 3.30 | 26.30 | 29.95 | 2.0 | bal. |
| 132 | 19.70 | 6.60 | 0.35 | 3.30 | 26.30 | 29.95 | 2.0 | bal. |
| 133 | 26.30 | 0.00 | 0.35 | 3.30 | 26.30 | 29.95 | 2.0 | bal. |
| 134 | 21.30 | 5.00 | 0.35 | 3.30 | 26.30 | 29.95 | 2.0 | bal. |
| 17 | 19.70 | 6.60 | 0.35 | 3.30 | 26.30 | 29.95 | 2.0 | bal. |
| 135 | 16.30 | 10.0 | 0.35 | 3.30 | 26.30 | 29.95 | 2.0 | bal. |

| | R-T-B based sintered magnet composition (after Tb diffusion) | | | | | | | |
|---|---|---|---|---|---|---|---|---|
| | | M | | | | | | |
| Sample No. | B (mass %) | Al (mass %) | Ga (mass %) | Cu (mass %) | Mn (mass %) | Zr (mass %) | Tb/C (atomic ratio) | C (ppm) |
| 91 | 0.93 | 0.20 | 0.20 | 0.20 | 0.03 | 0.15 | 0.29 | 900 |
| 92 | 0.93 | 0.20 | 0.20 | 0.20 | 0.03 | 0.15 | 0.29 | 900 |
| 17 | 0.93 | 0.20 | 0.20 | 0.20 | 0.03 | 0.15 | 0.29 | 900 |
| 94 | 0.93 | 0.20 | 0.20 | 0.20 | 0.03 | 0.15 | 0.29 | 900 |
| 95 | 0.93 | 0.15 | 0.20 | 0.20 | 0.03 | 0.15 | 0.29 | 900 |
| 17 | 0.93 | 0.20 | 0.20 | 0.20 | 0.03 | 0.15 | 0.29 | 900 |

TABLE 3-continued

| | | | | | | | | |
|---|---|---|---|---|---|---|---|---|
| 97 | 0.93 | 0.25 | 0.20 | 0.20 | 0.03 | 0.15 | 0.29 | 900 |
| 98 | 0.93 | 0.30 | 0.20 | 0.20 | 0.03 | 0.15 | 0.29 | 900 |
| 99 | 0.93 | 0.20 | 0.20 | 0.04 | 0.03 | 0.15 | 0.29 | 900 |
| 100 | 0.93 | 0.20 | 0.20 | 0.10 | 0.03 | 0.15 | 0.29 | 900 |
| 17 | 0.93 | 0.20 | 0.20 | 0.20 | 0.03 | 0.15 | 0.29 | 900 |
| 102 | 0.93 | 0.20 | 0.20 | 0.30 | 0.03 | 0.15 | 0.29 | 900 |
| 103 | 0.93 | 0.20 | 0.20 | 0.50 | 0.03 | 0.15 | 0.29 | 900 |
| 104 | 0.93 | 0.20 | 0.08 | 0.20 | 0.03 | 0.15 | 0.29 | 900 |
| 105 | 0.93 | 0.20 | 0.10 | 0.20 | 0.03 | 0.15 | 0.29 | 900 |
| 17 | 0.93 | 0.20 | 0.20 | 0.20 | 0.03 | 0.15 | 0.29 | 900 |
| 106 | 0.93 | 0.20 | 0.25 | 0.20 | 0.03 | 0.15 | 0.29 | 900 |
| 107 | 0.93 | 0.20 | 0.30 | 0.20 | 0.03 | 0.15 | 0.29 | 900 |
| 109 | 0.93 | 0.20 | 0.20 | 0.20 | 0.03 | 0.10 | 0.29 | 900 |
| 17 | 0.93 | 0.20 | 0.20 | 0.20 | 0.03 | 0.15 | 0.29 | 900 |
| 111 | 0.93 | 0.20 | 0.20 | 0.20 | 0.03 | 0.25 | 0.29 | 900 |
| 112 | 0.93 | 0.20 | 0.20 | 0.20 | 0.03 | 0.30 | 0.29 | 900 |
| 113 | 0.93 | 0.20 | 0.20 | 0.20 | 0.03 | 0.15 | 0.44 | 600 |
| 114 | 0.93 | 0.20 | 0.20 | 0.20 | 0.03 | 0.15 | 0.35 | 750 |
| 17 | 0.93 | 0.20 | 0.20 | 0.20 | 0.03 | 0.15 | 0.29 | 900 |
| 115 | 0.93 | 0.20 | 0.20 | 0.20 | 0.03 | 0.15 | 0.26 | 1000 |
| 116 | 0.93 | 0.20 | 0.20 | 0.20 | 0.03 | 0.15 | 0.24 | 1100 |
| 117 | 0.93 | 0.20 | 0.20 | 0.20 | 0.03 | 0.15 | 0.21 | 1100 |
| 118 | 0.93 | 0.20 | 0.20 | 0.20 | 0.03 | 0.15 | 0.63 | 600 |
| 119 | 0.93 | 0.20 | 0.20 | 0.20 | 0.03 | 0.15 | 0.13 | 900 |
| 120 | 0.93 | 0.20 | 0.20 | 0.20 | 0.03 | 0.15 | 0.17 | 900 |
| 121 | 0.93 | 0.20 | 0.20 | 0.20 | 0.03 | 0.15 | 0.42 | 900 |
| 121a | 0.93 | 0.20 | 0.20 | 0.20 | 0.03 | 0.15 | 0.63 | 900 |
| 122 | 0.93 | 0.20 | 0.20 | 0.20 | 0.03 | 0.15 | 0.42 | 900 |
| 123 | 0.93 | 0.20 | 0.20 | 0.20 | 0.03 | 0.15 | 0.25 | 900 |
| 124 | 0.93 | 0.20 | 0.20 | 0.20 | 0.03 | 0.15 | 0.29 | 900 |
| 125 | 0.93 | 0.20 | 0.20 | 0.20 | 0.03 | 0.15 | 0.29 | 900 |
| 17 | 0.93 | 0.20 | 0.20 | 0.20 | 0.03 | 0.15 | 0.29 | 900 |
| 126 | 0.93 | 0.20 | 0.20 | 0.20 | 0.03 | 0.15 | 0.29 | 900 |
| 127 | 0.93 | 0.20 | 0.20 | 0.20 | 0.03 | 0.15 | 0.29 | 900 |
| 128 | 0.93 | 0.20 | 0.20 | 0.20 | 0.03 | 0.15 | 0.29 | 900 |
| 129 | 0.93 | 0.20 | 0.20 | 0.20 | 0.03 | 0.15 | 0.29 | 900 |
| 17 | 0.93 | 0.20 | 0.20 | 0.20 | 0.03 | 0.15 | 0.29 | 900 |
| 130 | 0.93 | 0.20 | 0.20 | 0.20 | 0.03 | 0.15 | 0.29 | 900 |
| 131 | 0.93 | 0.20 | 0.20 | 0.20 | 0.03 | 0.15 | 0.29 | 900 |
| 132 | 0.93 | 0.20 | 0.20 | 0.20 | 0.03 | 0.15 | 0.29 | 900 |
| 133 | 0.93 | 0.20 | 0.20 | 0.20 | 0.03 | 0.15 | 0.29 | 900 |
| 134 | 0.93 | 0.20 | 0.20 | 0.20 | 0.03 | 0.15 | 0.29 | 900 |
| 17 | 0.93 | 0.20 | 0.20 | 0.20 | 0.03 | 0.15 | 0.29 | 900 |
| 135 | 0.93 | 0.20 | 0.20 | 0.20 | 0.03 | 0.15 | 0.29 | 900 |

| | R-T-B based sintered magnet composition (after Tb diffusion) | | | | | | | | |
|---|---|---|---|---|---|---|---|---|---|
| Sample No. | N (ppm) | O (ppm) | Br (mT) | HcJ (kA/m) | PI | Hk/HcJ (%) | PI, Hk/HcJ Evaluation | Demagnetization factor at high temperature (%) | Corrosion resistance |
| 91 | 500 | 500 | 1363 | 2519 | 1759 | 98.1 | ○ | 0 | ○ |
| 92 | 500 | 500 | 1364 | 2527 | 1761 | 98.1 | ○ | 0 | ◎ |
| 17 | 500 | 500 | 1362 | 2550 | 1763 | 98.1 | ○ | 0 | ◎ |
| 94 | 500 | 500 | 1364 | 2503 | 1757 | 98.0 | ○ | 0 | ◎ |
| 95 | 500 | 500 | 1371 | 2500 | 1764 | 97.9 | ○ | 0 | ◎ |
| 17 | 500 | 500 | 1361 | 2554 | 1762 | 98.1 | ○ | 0 | ◎ |
| 97 | 500 | 500 | 1351 | 2590 | 1758 | 98.1 | ○ | 0 | ◎ |
| 98 | 500 | 500 | 1343 | 2622 | 1755 | 97.8 | ○ | 0 | ◎ |
| 99 | 500 | 500 | 1366 | 2519 | 1762 | 98.0 | ○ | 0 | ○ |
| 100 | 500 | 500 | 1367 | 2537 | 1766 | 97.7 | ○ | 0 | ◎ |
| 17 | 500 | 500 | 1362 | 2550 | 1763 | 98.1 | ○ | 0 | ◎ |
| 102 | 500 | 500 | 1361 | 2561 | 1763 | 98.2 | ○ | 0 | ◎ |
| 103 | 500 | 500 | 1356 | 2515 | 1751 | 97.6 | ○ | 0 | ◎ |
| 104 | 500 | 500 | 1364 | 2528 | 1761 | 98.3 | ○ | 0 | ◎ |
| 105 | 500 | 500 | 1362 | 2524 | 1758 | 98.5 | ○ | 0 | ◎ |
| 17 | 500 | 500 | 1362 | 2550 | 1763 | 98.1 | ○ | 0 | ◎ |
| 106 | 500 | 500 | 1362 | 2557 | 1764 | 98.3 | ○ | 0 | ◎ |
| 107 | 500 | 500 | 1361 | 2576 | 1766 | 98.1 | ○ | 0 | ◎ |
| 109 | 500 | 500 | 1362 | 2552 | 1763 | 98.0 | ○ | 0 | ◎ |
| 17 | 500 | 500 | 1362 | 2550 | 1763 | 98.1 | ○ | 0 | ◎ |
| 111 | 500 | 500 | 1356 | 2553 | 1757 | 97.2 | ○ | 0 | ◎ |
| 112 | 500 | 500 | 1349 | 2560 | 1751 | 97.2 | ○ | 0 | ◎ |
| 113 | 500 | 500 | 1360 | 2597 | 1768 | 95.8 | ○ | 0 | ◎ |
| 114 | 500 | 500 | 1359 | 2591 | 1766 | 95.4 | ○ | 0 | ◎ |
| 17 | 500 | 500 | 1362 | 2550 | 1763 | 98.1 | ○ | 0 | ◎ |
| 115 | 500 | 500 | 1364 | 2526 | 1761 | 98.0 | ○ | 0 | ◎ |
| 116 | 500 | 500 | 1365 | 2498 | 1757 | 98.0 | ○ | 0 | ◎ |
| 117 | 500 | 500 | 1364 | 2448 | 1749 | 98.2 | ○ | 0 | ◎ |

TABLE 3-continued

| | | | | | | | | | |
|---|---|---|---|---|---|---|---|---|---|
| 118 | 500 | 500 | 1357 | 2637 | 1771 | 95.5 | ○ | 0 | ◎ |
| 119 | 500 | 500 | 1364 | 2404 | 1742 | 98.2 | ○ | 0 | ◎ |
| 120 | 500 | 500 | 1362 | 2476 | 1751 | 98.0 | ○ | 0 | ◎ |
| 121 | 500 | 500 | 1360 | 2596 | 1768 | 98.0 | ○ | 0 | ◎ |
| 121a | 500 | 500 | 1354 | 2625 | 1766 | 97.9 | ○ | 0 | ◎ |
| 122 | 500 | 500 | 1343 | 2605 | 1752 | 97.2 | ○ | 0 | ◎ |
| 123 | 500 | 500 | 1368 | 2413 | 1747 | 98.6 | ○ | 0 | ◎ |
| 124 | 500 | 350 | 1360 | 2556 | 1761 | 98.2 | ○ | 0 | ◎ |
| 125 | 500 | 400 | 1364 | 2558 | 1766 | 97.9 | ○ | 0 | ◎ |
| 17 | 500 | 500 | 1362 | 2550 | 1763 | 98.1 | ○ | 0 | ◎ |
| 126 | 500 | 800 | 1364 | 2559 | 1766 | 98.0 | ○ | 0 | ◎ |
| 127 | 500 | 1000 | 1362 | 2544 | 1762 | 98.0 | ○ | 0 | ◎ |
| 128 | 250 | 500 | 1361 | 2588 | 1768 | 98.1 | ○ | 0 | ◎ |
| 129 | 300 | 500 | 1362 | 2586 | 1768 | 98.2 | ○ | 0 | ◎ |
| 17 | 500 | 500 | 1362 | 2550 | 1763 | 98.1 | ○ | 0 | ◎ |
| 130 | 600 | 500 | 1363 | 2534 | 1761 | 98.0 | ○ | 0 | ◎ |
| 131 | 700 | 500 | 1362 | 2511 | 1756 | 98.0 | ○ | 0 | ◎ |
| 132 | 1000 | 500 | 1361 | 2483 | 1751 | 98.0 | ○ | 0 | ◎ |
| 133 | 500 | 500 | 1364 | 2535 | 1762 | 98.2 | ○ | 0 | ◎ |
| 134 | 500 | 500 | 1362 | 2539 | 1761 | 98.1 | ○ | 0 | ◎ |
| 17 | 500 | 500 | 1362 | 2550 | 1763 | 98.1 | ○ | 0 | ◎ |
| 135 | 500 | 500 | 1361 | 2567 | 1764 | 98.1 | ○ | 0 | ○ |

In Table 1, TRE and B were varied. Also, Nd and Pr were included so that the mass ratio of Nd and Pr were approximately 3:1. In Table 2, TRE and Dy were varied. For the sample numbers 91 to 132 shown in Table 3, the contents of components except for B were varied. Also, for the sample numbers 133 to 135, the content of TRE was fixed, and the contents of Nd and Pr were varied.

According to Tables 1 to 3, in all Examples, Br, HcJ, PI, squareness ratio, and corrosion resistance were good. On the other hand, in all Comparative Examples, at least one of Br, HcJ, PI, the squareness ratio, and the corrosion resistance was not good. For the R-T-B based sintered magnets of all Examples and Comparative Examples, the concentration distribution of Tb was analyzed using an electron probe micro analyzer (EPMA), and it was confirmed that the concentration distribution of Tb decreased from the outer side to the inner side.

The example having the content of Dy of 2.5 mass % or more and 6.5 mass % or less, and Tb/C of 0.10 or more and 0.95 or less tended to have a good demagnetization factor at high temperature.

Further, the example having the content of C of 900 ppm to 1100 ppm tended to have good squareness ratio.

NUMERICAL REFERENCES

1 . . . R-T-B based permanent magnet

The invention claimed is:

1. An R-T-B based permanent magnet comprising M, wherein

R is a rare earth element, T is Fe and Co, and B is boron, R at least includes Pr, Dy and Tb, M is one or more elements selected from the group consisting of Cu, Ga, Al, Mn, Zr, Ti, Cr, Ni, Nb, Ag, Hf, Ta, W, Si, Bi, and Sn, M at least includes Cu and Mn, relative to 100 mass % of a total mass of R, T, B, and M, a total content of R is 29.45 mass % to 30.60 mass %, a content of Pr is larger than 0 mass % and 10.0 mass % or less, a content of Dy is 2.5 mass % to 6.5 mass %, a content of Cu is 0.04 mass % to 0.50 mass %, a content of Mn is 0.02 mass % to 0.10 mass %, a content of Co is 0.5 mass % to 3.0 mass %, and a content of B is 0.85 mass % to 0.95 mass %, an atomic ratio of Tb/C is 0.10 to 0.95, a content of O in the R-T-B based permanent magnet is 350 ppm or more to 800 ppm or less, a concentration distribution of Tb decreases from an outer side towards an inner side of the R-T-B based permanent magnet, Hk/HcJ≥95.0% is satisfied where Hk (kA/m) is a magnitude of a magnetic field when a magnetization J reached 90% of Br in a second quadrant (J-H demagnetization curve) of a magnetization J-magnetic field H curve, and PI≥1740 is satisfied where PI=Br+25×HcJ×4π/2,000, a magnitude of a residual magnetic flux density measured by mT unit is Br (mT), and a magnitude of the coercive force measured by kA/m unit is HcJ (kA/m).

2. The R-T-B based permanent magnet according to claim 1, wherein R at least includes Nd.

3. The R-T-B based permanent magnet according to claim 1, wherein an atomic ratio of TRE/B is 2.21 to 2.62, where TRE is a total content of R.

4. The R-T-B based permanent magnet according to claim 2, wherein an atomic ratio of TRE/B is 2.21 to 2.62, where TRE is a total content of R.

5. The R-T-B based permanent magnet according to claim 1, wherein an atomic ratio of 14B/(Fe+Co) is 1.01 or less.

6. The R-T-B based permanent magnet according to claim 2, wherein an atomic ratio of 14B/(Fe+Co) is 1.01 or less.

* * * * *